US007677039B1

(12) United States Patent
Fleck

(10) Patent No.: US 7,677,039 B1
(45) Date of Patent: Mar. 16, 2010

(54) STIRLING ENGINE AND ASSOCIATED METHODS

(75) Inventor: Thomas Michael Fleck, Lexington, NC (US)

(73) Assignee: Fleck Technologies, Inc., Raleigh, NC (US)

( * ) Notice: Subject to any disclaimer, the term of this patent is extended or adjusted under 35 U.S.C. 154(b) by 1110 days.

(21) Appl. No.: 11/314,727

(22) Filed: Dec. 20, 2005

(51) Int. Cl.
*F01B 29/10* (2006.01)

(52) U.S. Cl. ..... 60/519; 60/520

(58) Field of Classification Search ..... 60/517, 60/519, 520

See application file for complete search history.

(56) References Cited

U.S. PATENT DOCUMENTS

| | | | | |
|---|---|---|---|---|
| 3,370,418 | A | | 2/1968 | Kelly |
| 3,509,718 | A | * | 5/1970 | Hohenhinnebusch et al. .. 60/519 |
| 4,009,573 | A | * | 3/1977 | Satz ..... 60/519 |
| 4,012,910 | A | | 3/1977 | Schuman |
| 4,072,010 | A | | 2/1978 | Schuman |
| 4,388,808 | A | | 6/1983 | Durenec |
| 4,429,530 | A | | 2/1984 | Beale |
| 4,434,622 | A | | 3/1984 | Winkler |
| 4,539,818 | A | | 9/1985 | Holland |
| 4,574,591 | A | | 3/1986 | Bertsch |
| 4,606,194 | A | | 8/1986 | Pirtle et al. |
| 4,631,922 | A | | 12/1986 | Kleinwachter et al. |
| 4,753,073 | A | | 6/1988 | Chandler |
| 4,840,032 | A | | 6/1989 | Claudet et al. |
| 4,846,861 | A | | 7/1989 | Berry et al. |
| 4,852,356 | A | | 8/1989 | Unger et al. |
| 4,967,558 | A | | 11/1990 | Emigh et al. |
| 4,996,841 | A | | 3/1991 | Meijer et al. |
| 5,076,058 | A | | 12/1991 | Emigh et al. |
| 5,077,977 | A | | 1/1992 | Manor |
| 5,442,923 | A | | 8/1995 | Bareiss |
| 5,515,685 | A | | 5/1996 | Yanai et al. |
| 5,611,201 | A | | 3/1997 | Houtman |
| 5,779,455 | A | * | 7/1998 | Steiger ..... 417/418 |
| 6,062,023 | A | | 5/2000 | Kerwin et al. |
| 6,109,040 | A | | 8/2000 | Ellison, Jr. et al. |
| 6,164,263 | A | | 12/2000 | Saint-Hilaire et al. |
| 6,195,992 | B1 | | 3/2001 | Nommensen |
| 6,378,312 | B1 | | 4/2002 | Wang |
| 6,381,958 | B1 | | 5/2002 | Kamen et al. |
| 6,510,689 | B2 | | 1/2003 | Budliger |
| 6,701,708 | B2 | | 3/2004 | Gross et al. |

(Continued)

OTHER PUBLICATIONS

Myron D. Stokes, Quantum Parallel: The Saint-Hilaire "Quasiturbine" As the Basis for a Simultaneous Paradigm Shift in Vehicle Propulsion Systems, article, Copyright 2003, pp. 1-14, eMotion! Reports.com, Bloomfield Hills, MI.

(Continued)

*Primary Examiner*—Hoang M Nguyen
(74) *Attorney, Agent, or Firm*—Smith Moore Leatherwood LLP

(57) ABSTRACT

A stirling engine is disclosed. The engine includes at least two fluid chambers; a displacer, which may be rotary; and a movable seal. At least one displacer may be included in each of the at least two fluid chambers. The movable seal separates the at least two fluid chambers. In a further aspect, a stirling engine may include any one of at least one heat source, at least one heat sink, at least one converter, or any combination of any two or more of the preceding.

38 Claims, 23 Drawing Sheets

U.S. PATENT DOCUMENTS

| | | | |
|---|---|---|---|
| 6,952,921 | B2 | 10/2005 | Qiu |
| 2005/0000213 | A1 | 1/2005 | Cameron |

OTHER PUBLICATIONS

Brent H. Van Arsdell, Extremely Interesting Model Stirling Engines, guide and catalog, Copyright 2002, pp. 1-16, American Stirling Company, San Diego, CA.

University of Karlsruhe, Investigation of Concepts for High Power Stirling Engines, article, Copyright 2000, pp. 1-6, internet address http://www-ifkm.mach.uni-karlsruhe.de/Html-e/Project/Stirling/stirling.html.

Koichi Hirata, Plans of Rotary Displacer Type Stirling Engine, article, 8 pages, internet address http://www.bekkoame.ne.jp/~khirata/english/mk_rot.htm.

Rotary Stirling Engines, Rotary Stirling Engines, article, 22 pages, internet address http://www.rotarystirlingengines.com/.

QUASITURBINE.COM, Quasiturbine-A New Approach, 55 pages, internet address http://www.quasiturbine.com/EIndex.htm.

* cited by examiner

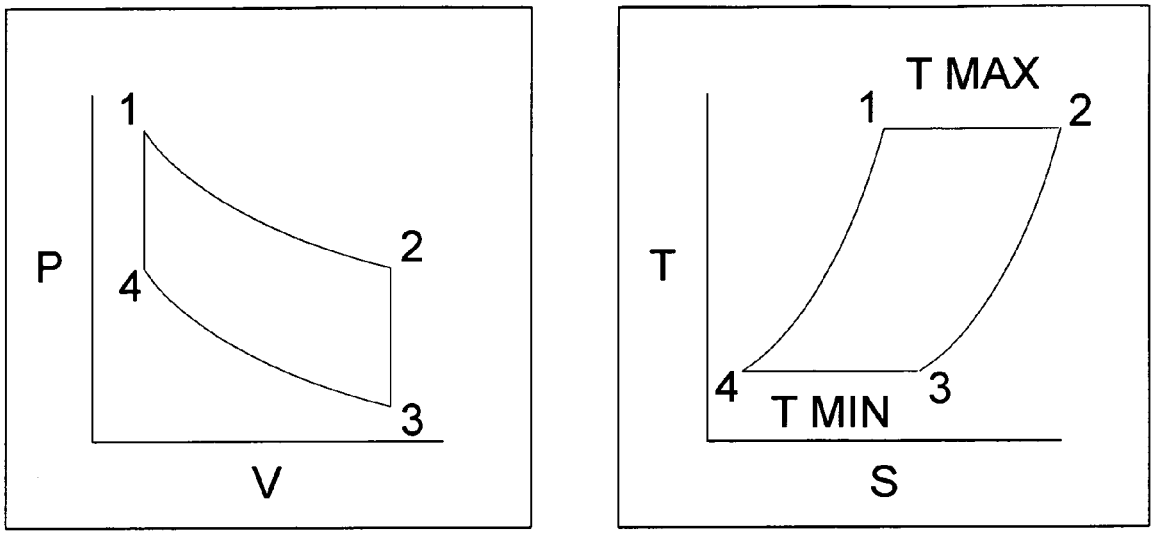
Figure 3A, RIGHT CHAMBER
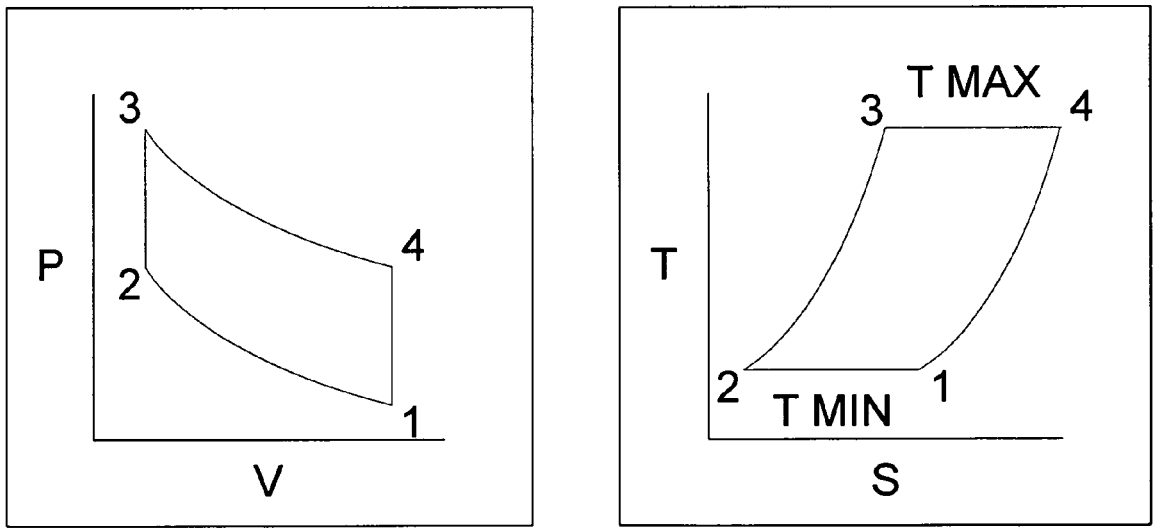
Figure 3B, LEFT CHAMBER

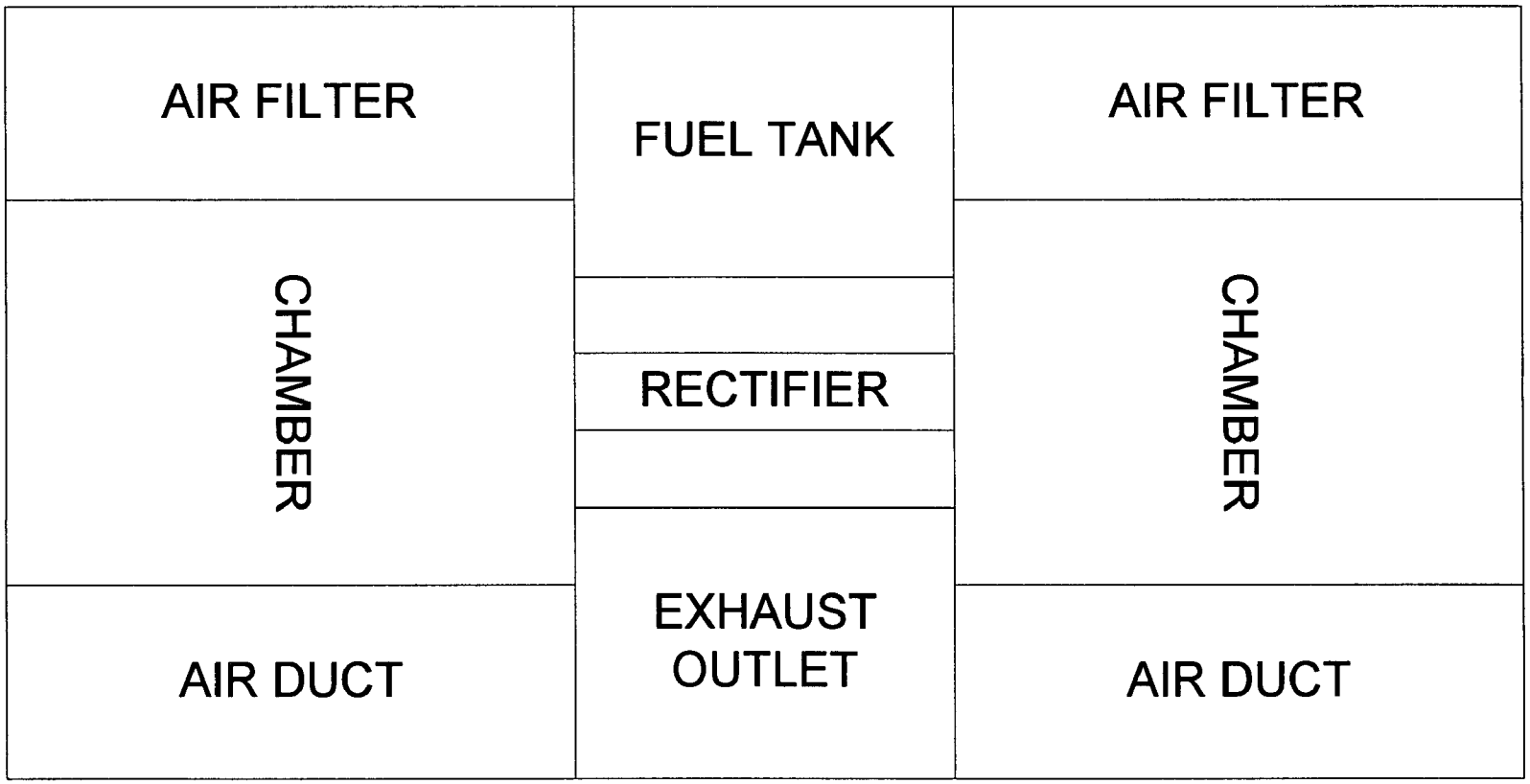
Figure 11A, Top View

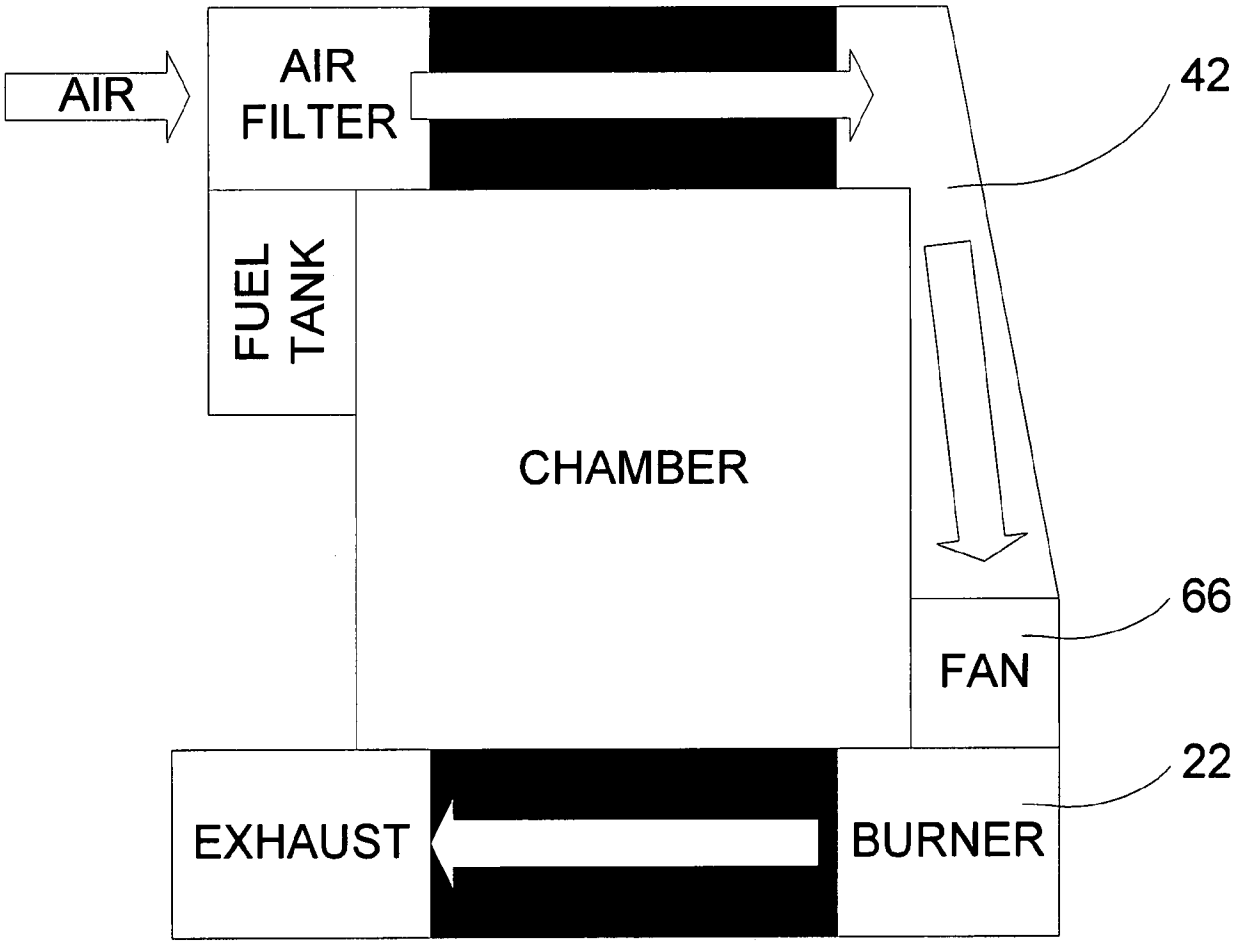
Figure 11B, End View

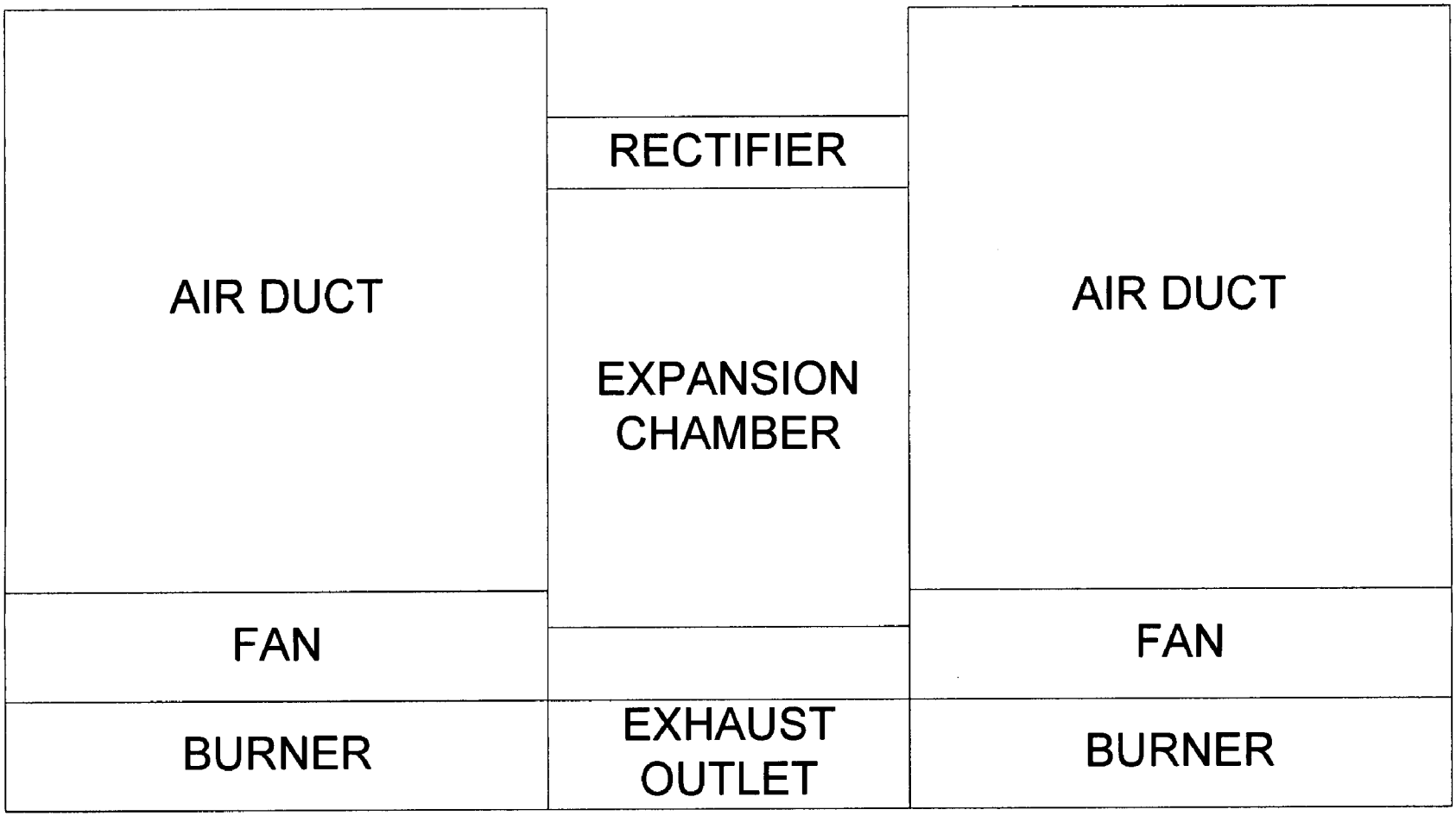
Figure 11C, Side View

STIRLING ENGINE AND ASSOCIATED METHODS

Figure 1:
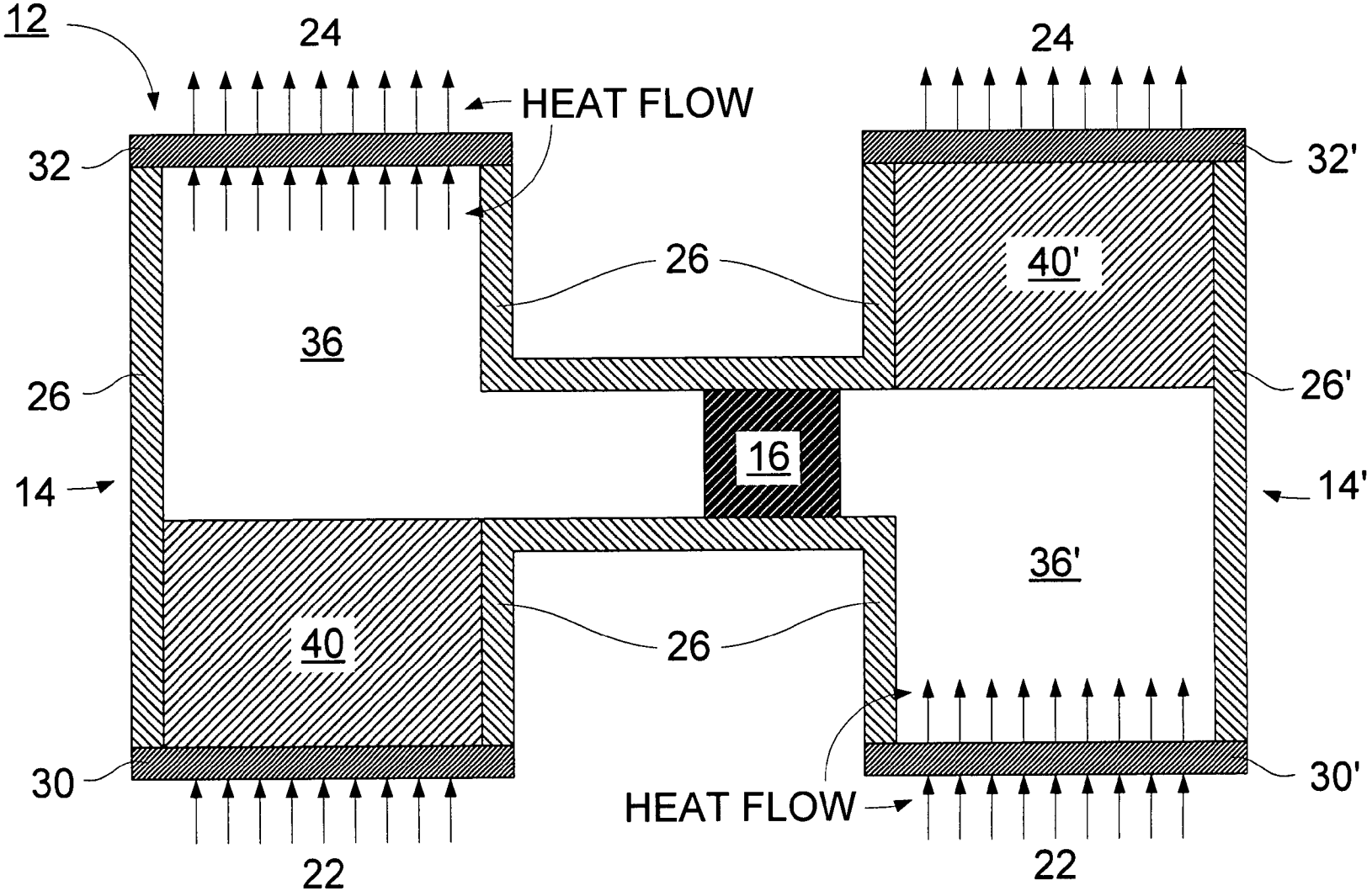
FIG. 1 is a diagram illustrating a simplified cross-section of a stirling engine according to an aspect of the present invention and usable with any other aspects (whether any other aspect is taken alone or in any combination of aspects) of the present invention as may be illustrated and/or disclosed.
Figure 4A:
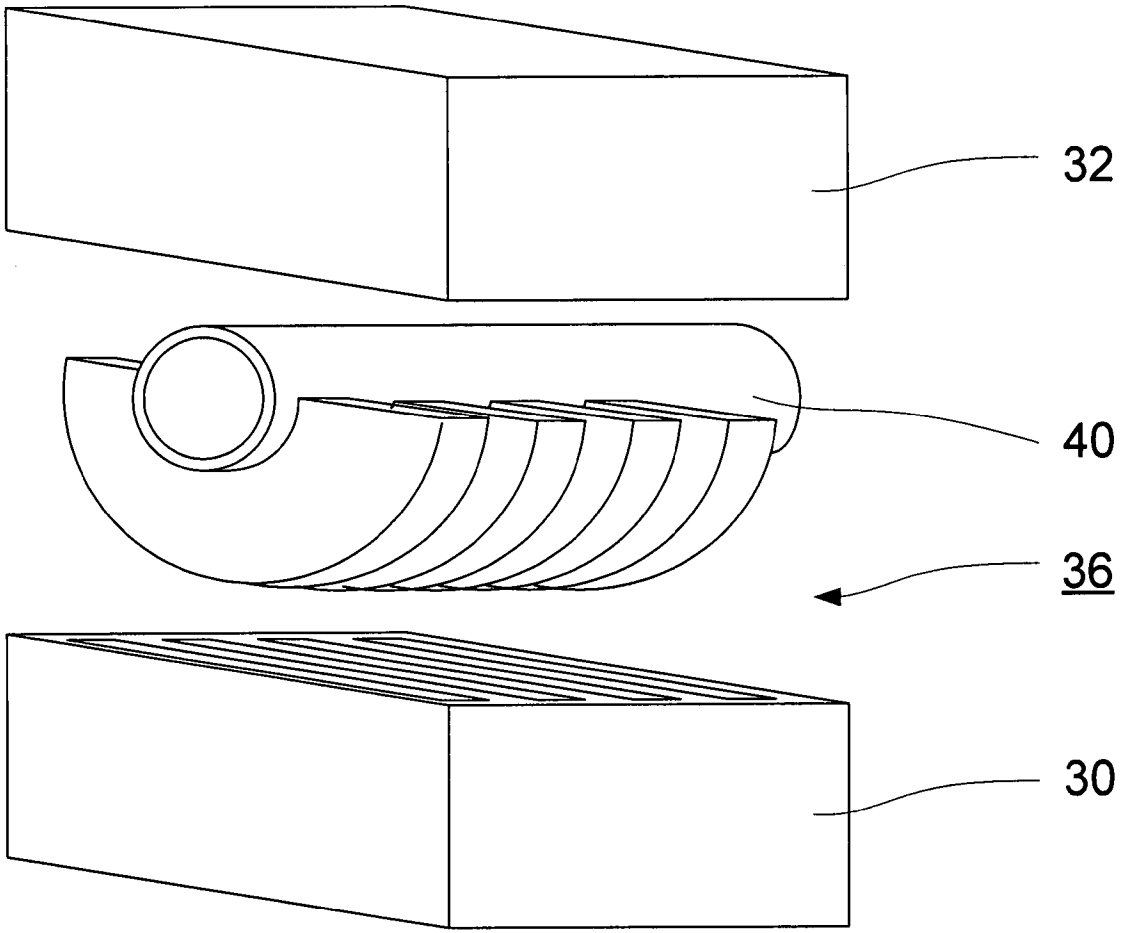
Figure 4B:
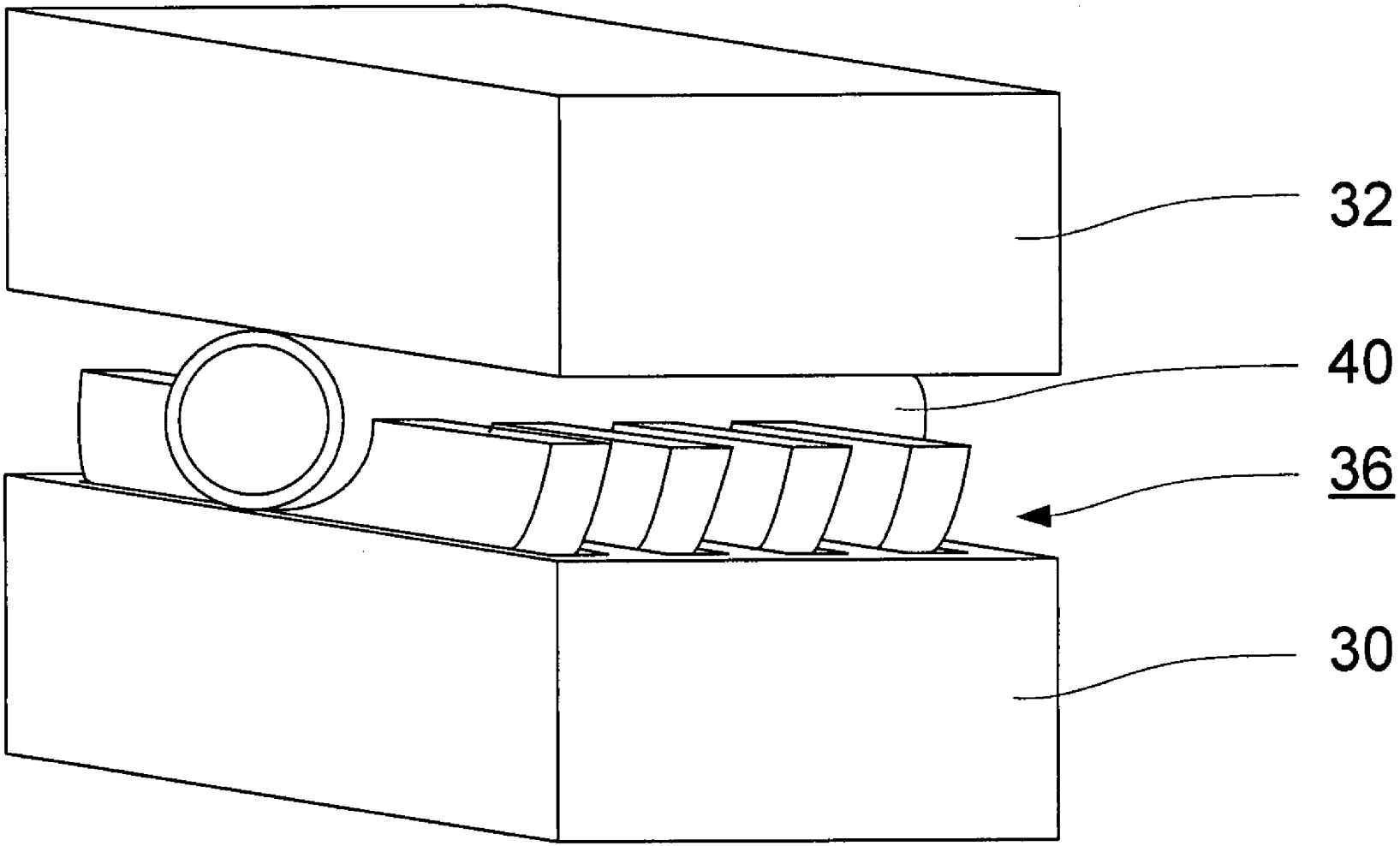
Figure 5A:
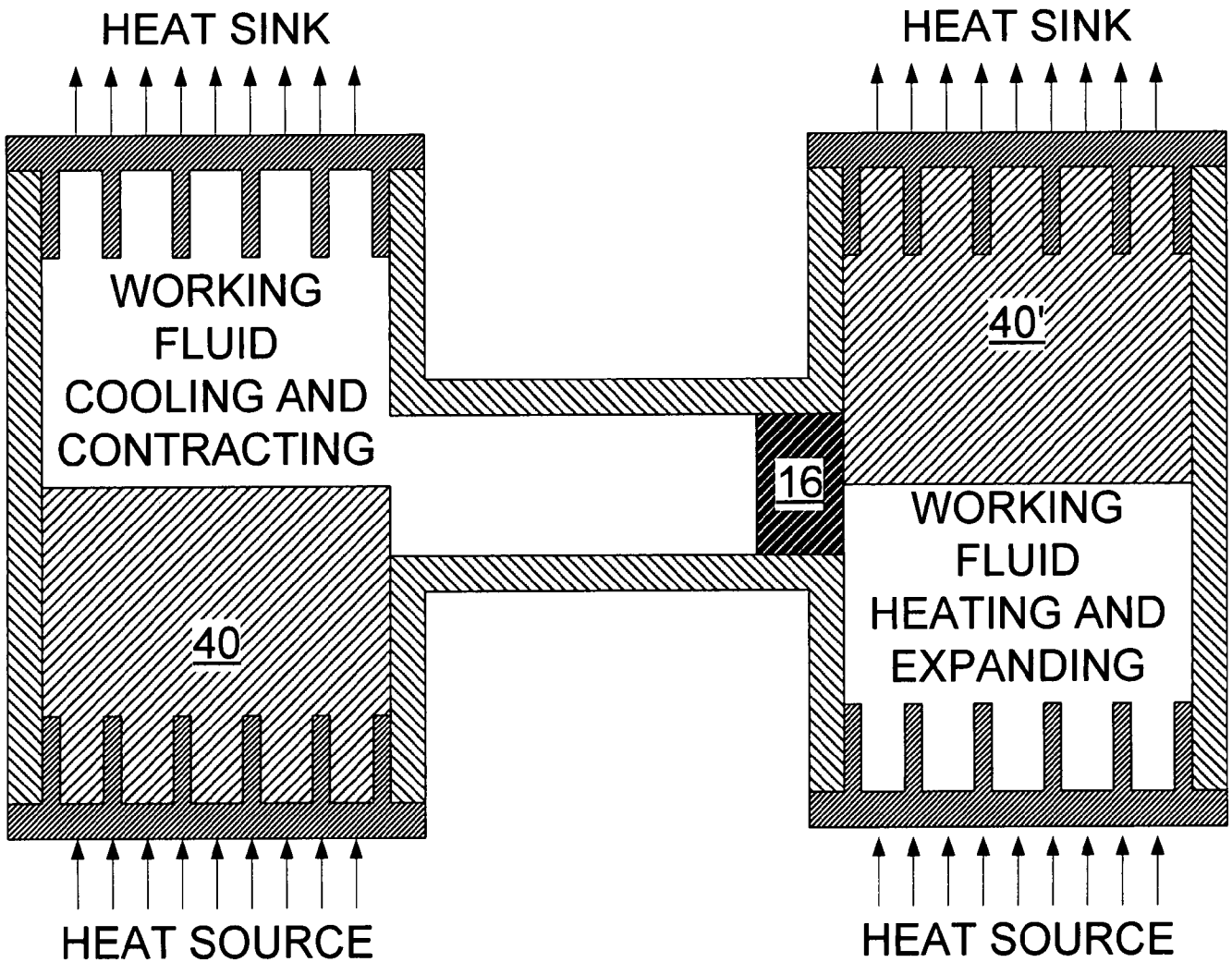
Figure 5B:
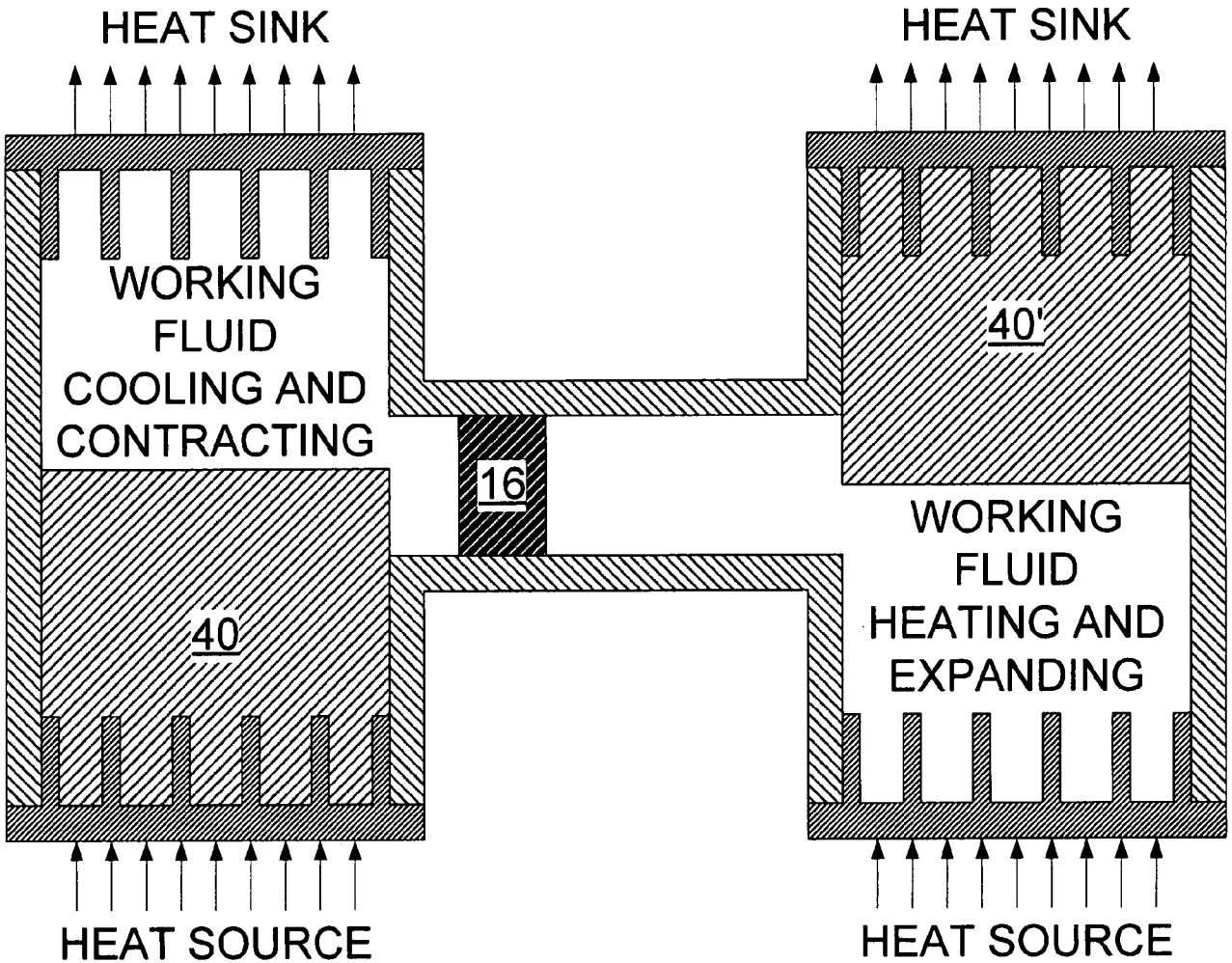
Figure 5C:
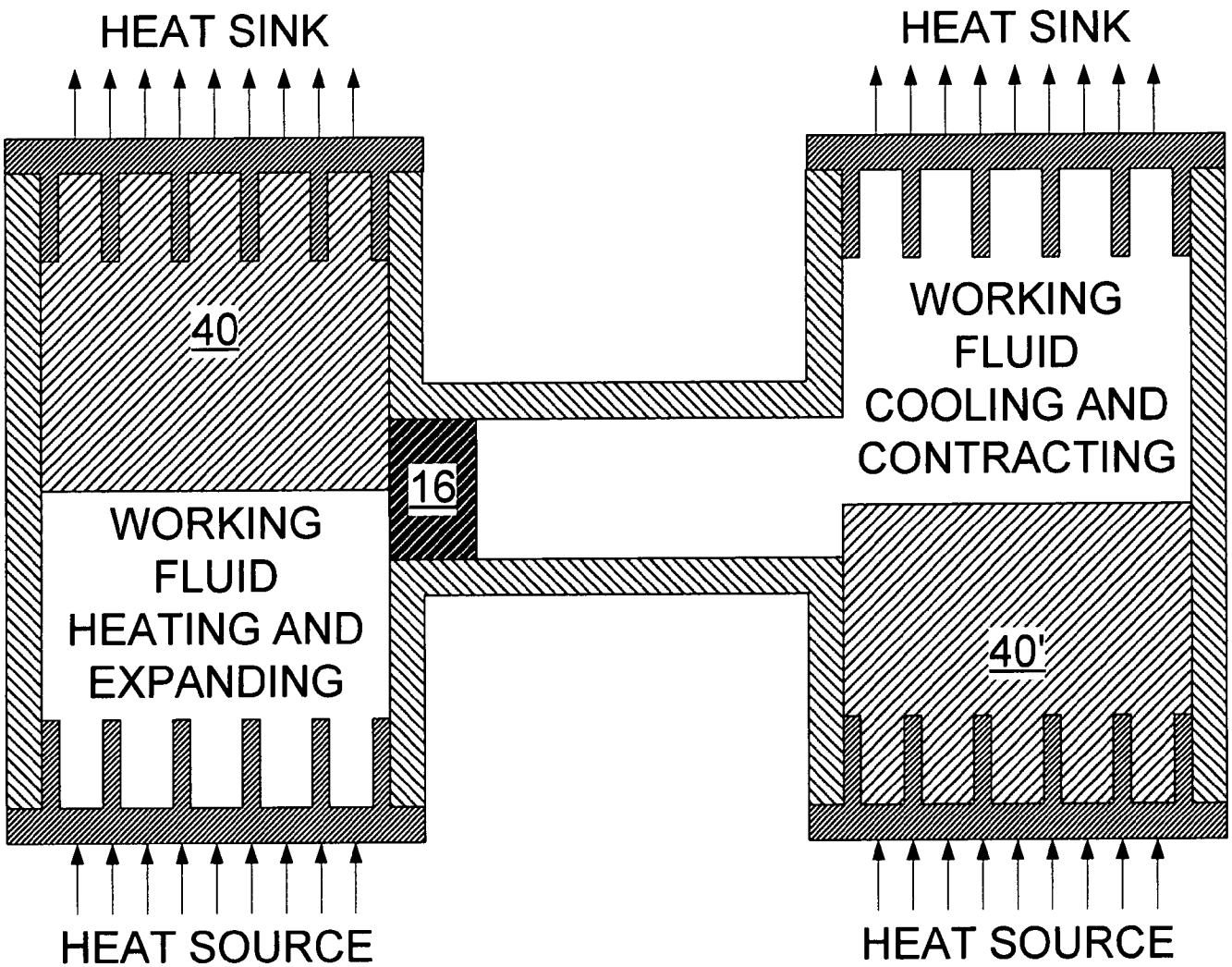
Figure 5D:
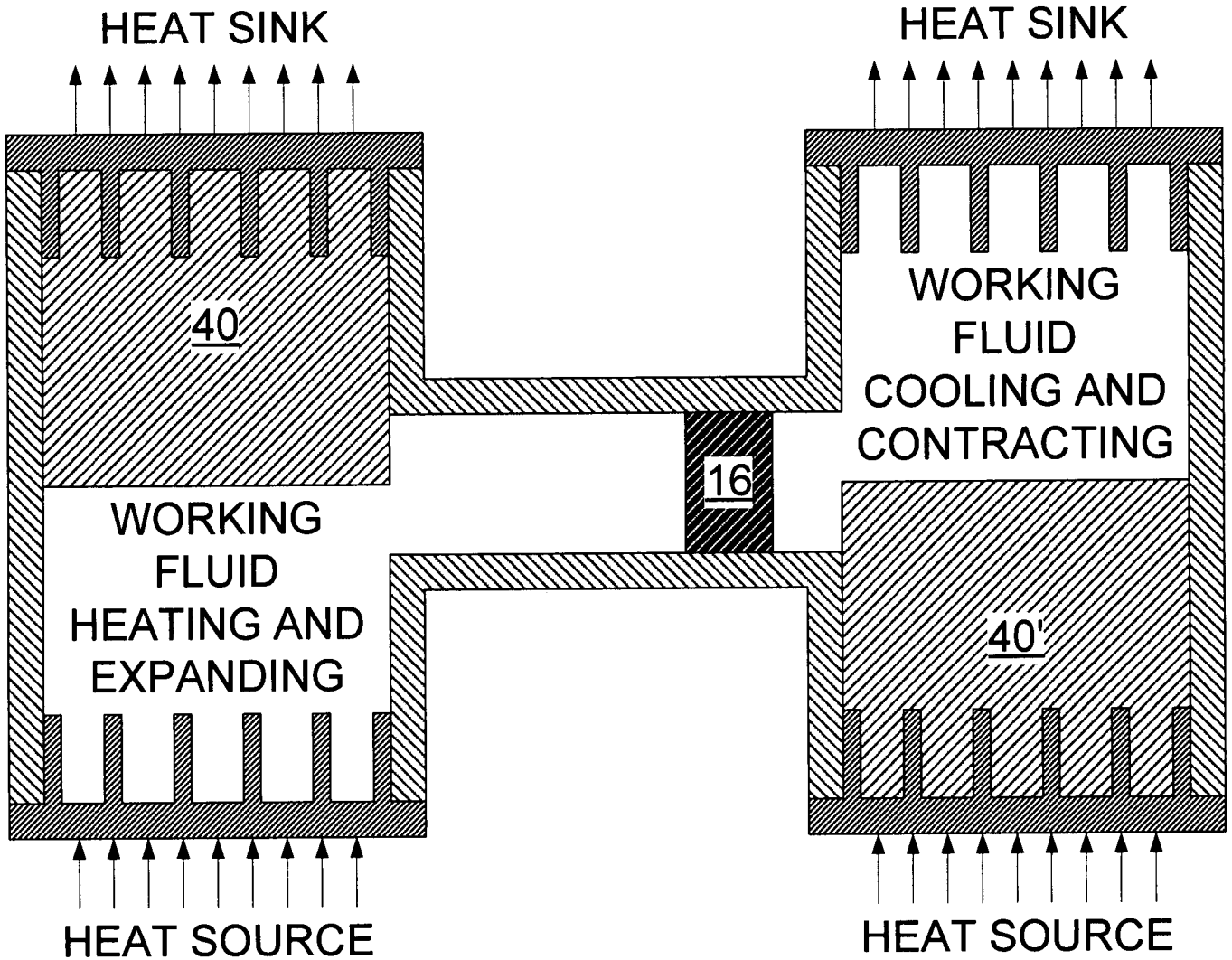
Figure 5E:
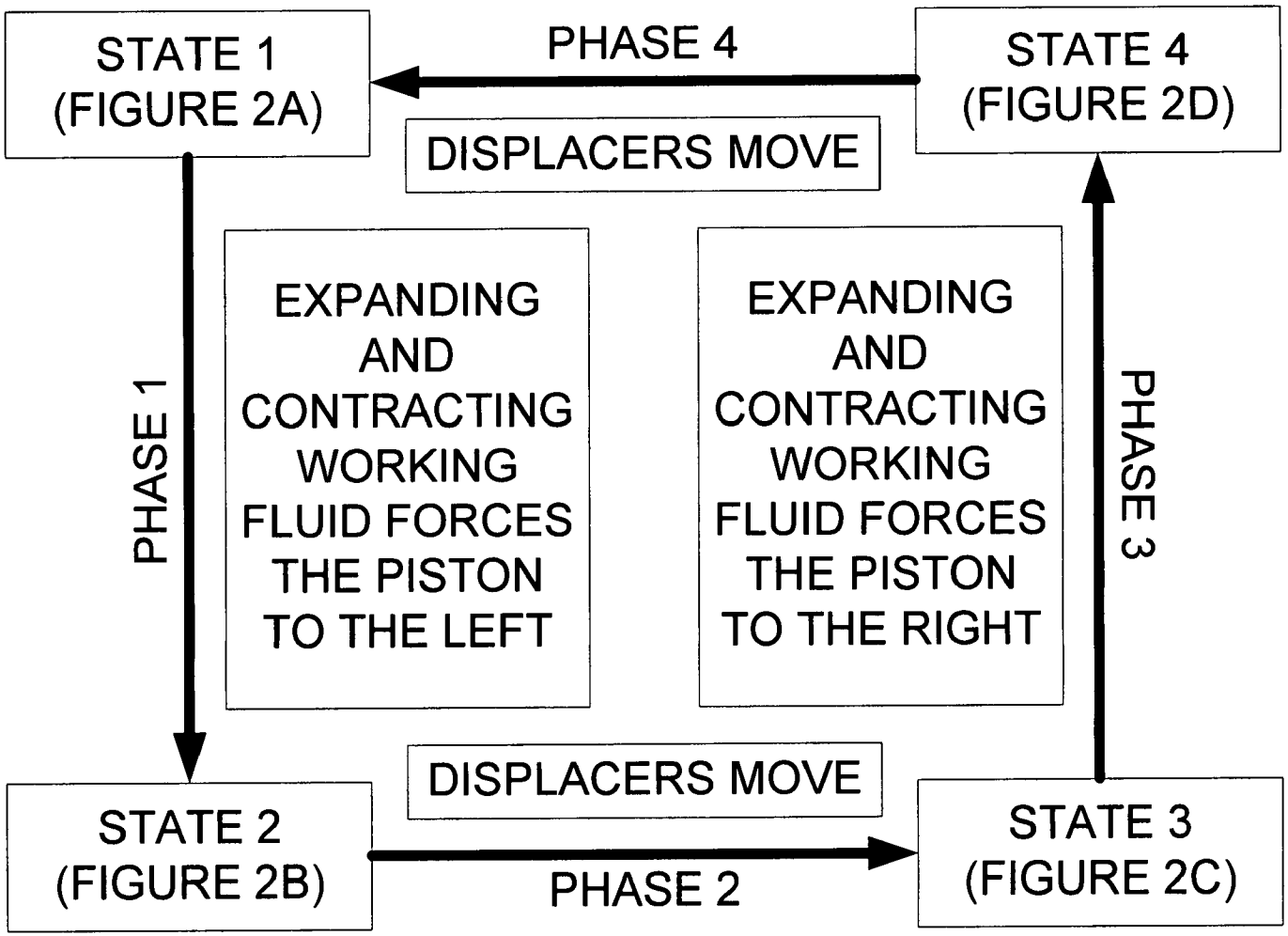
Figure 6A:
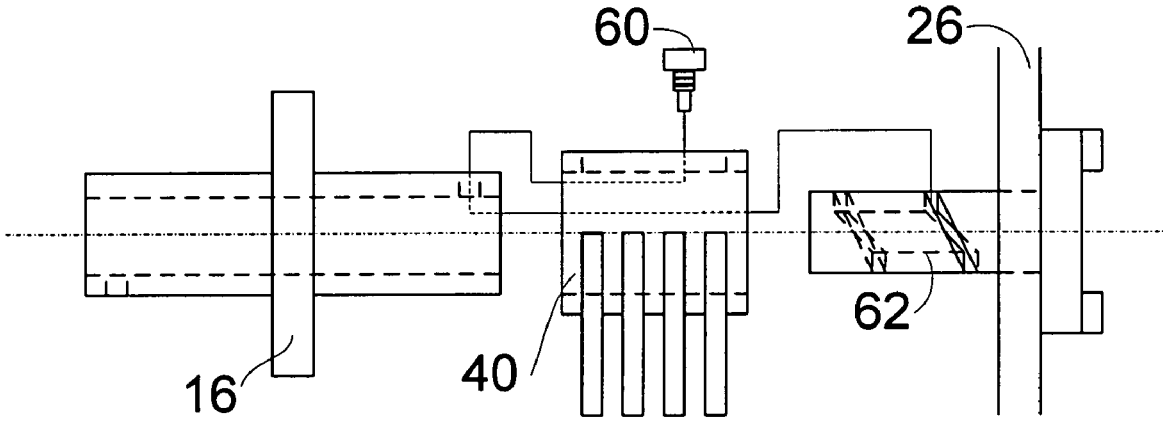
Figure 6B:
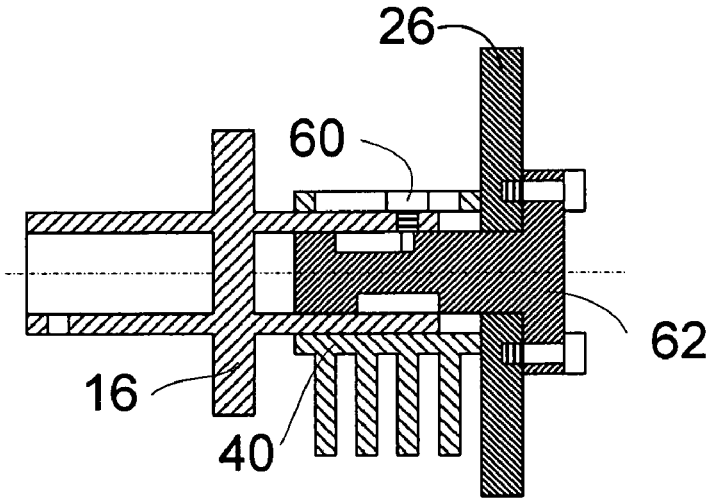
Figure 7:
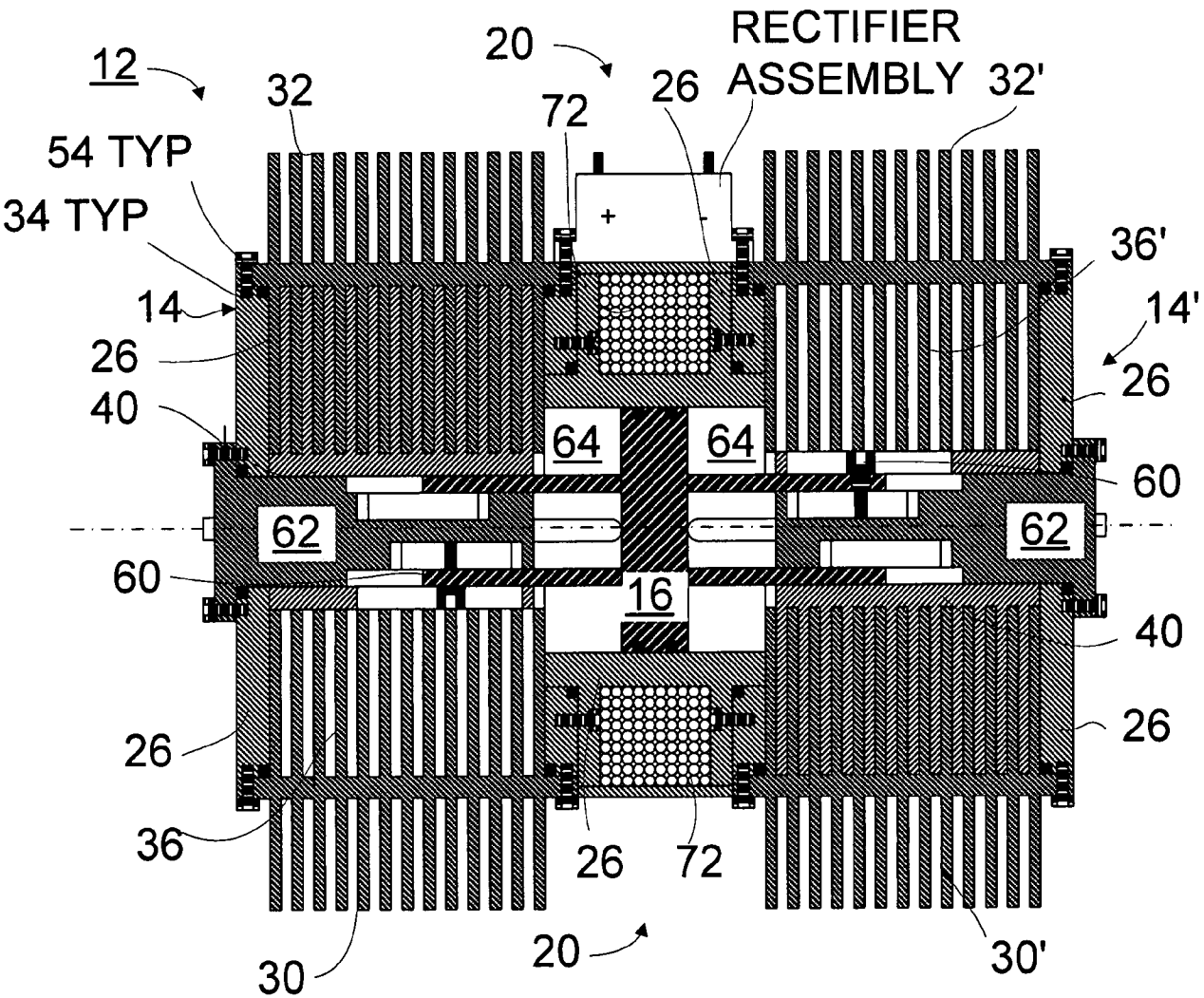
Figure 8:
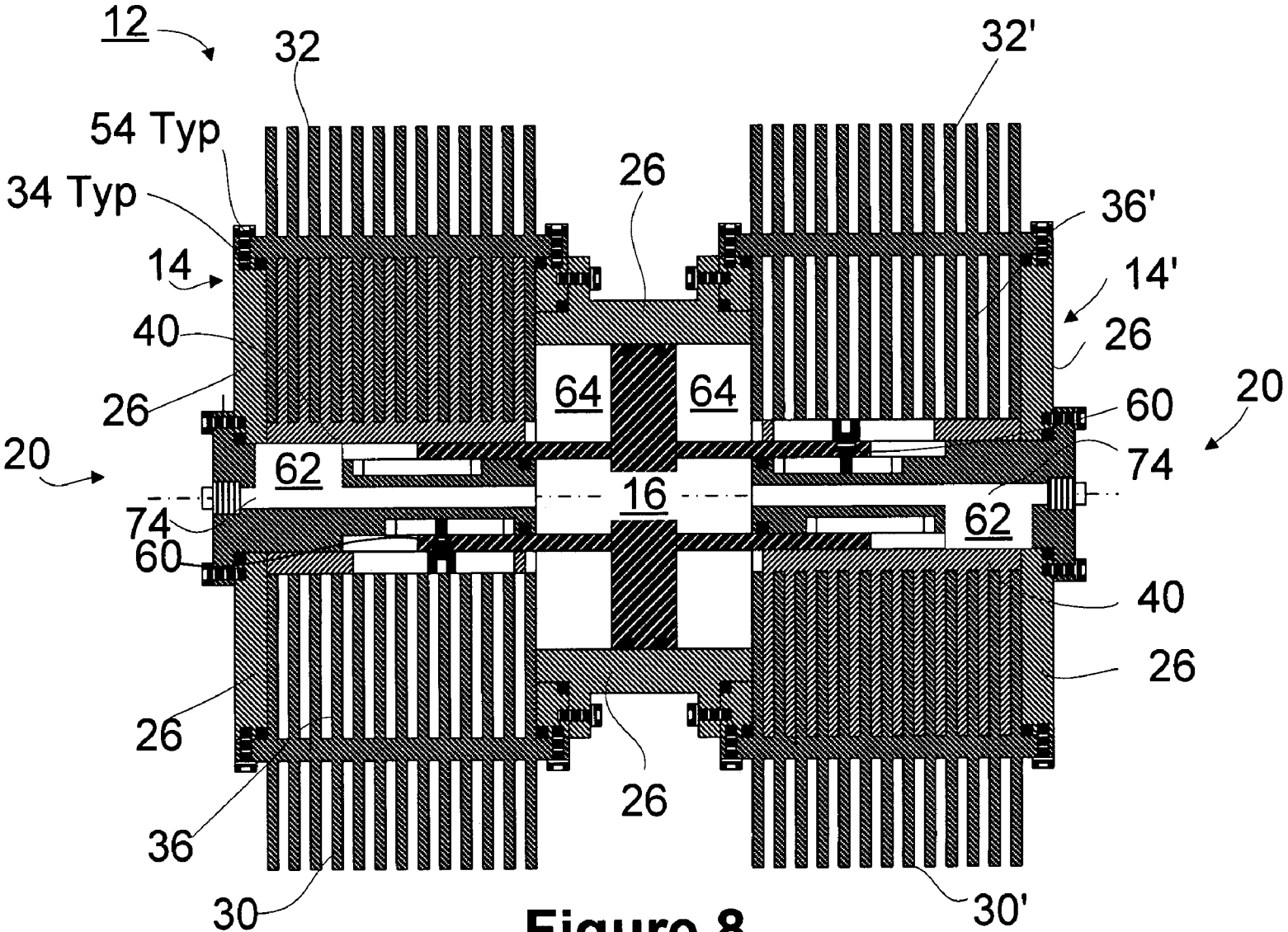
Figure 9:
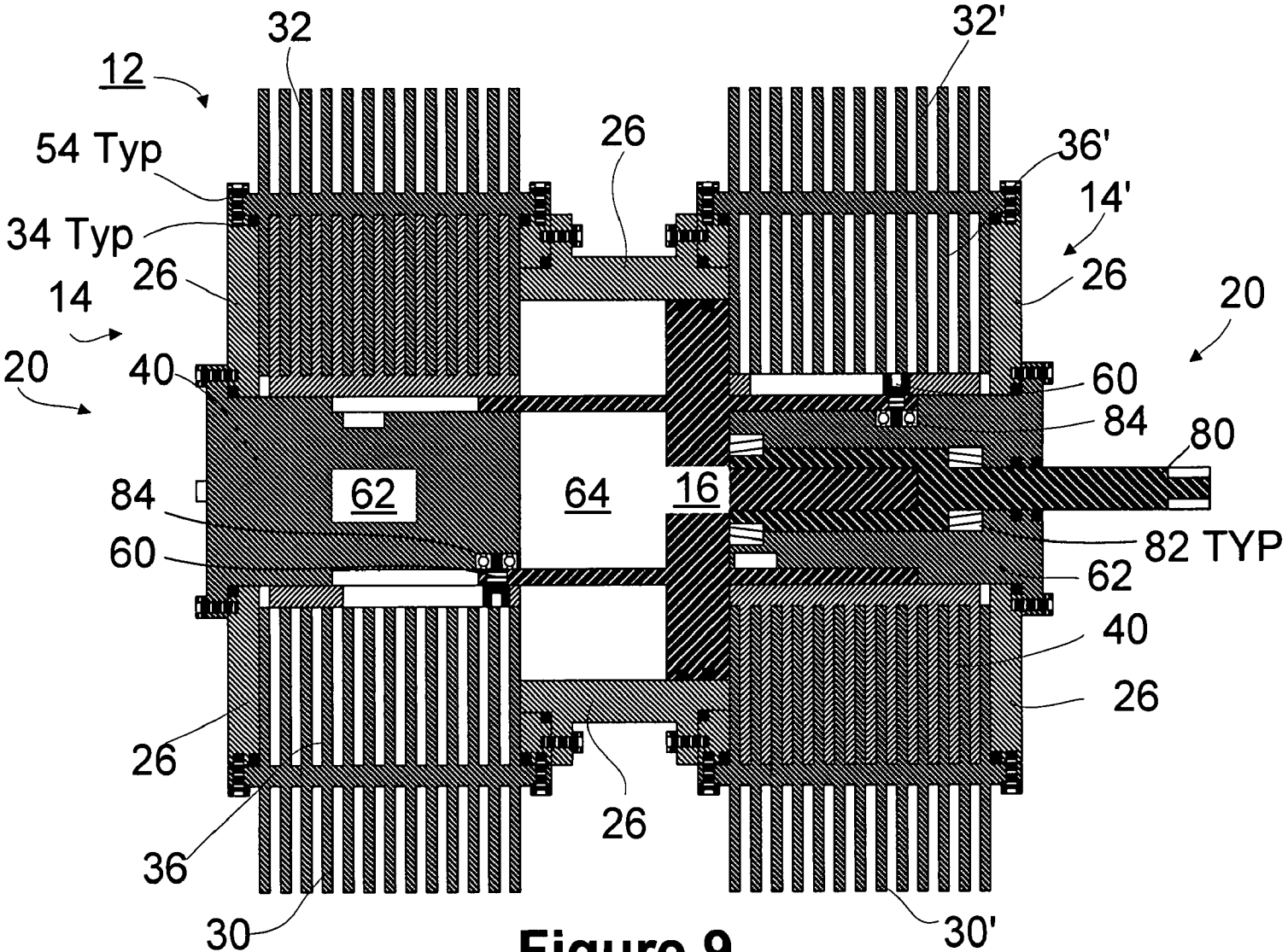
Figure 10B:
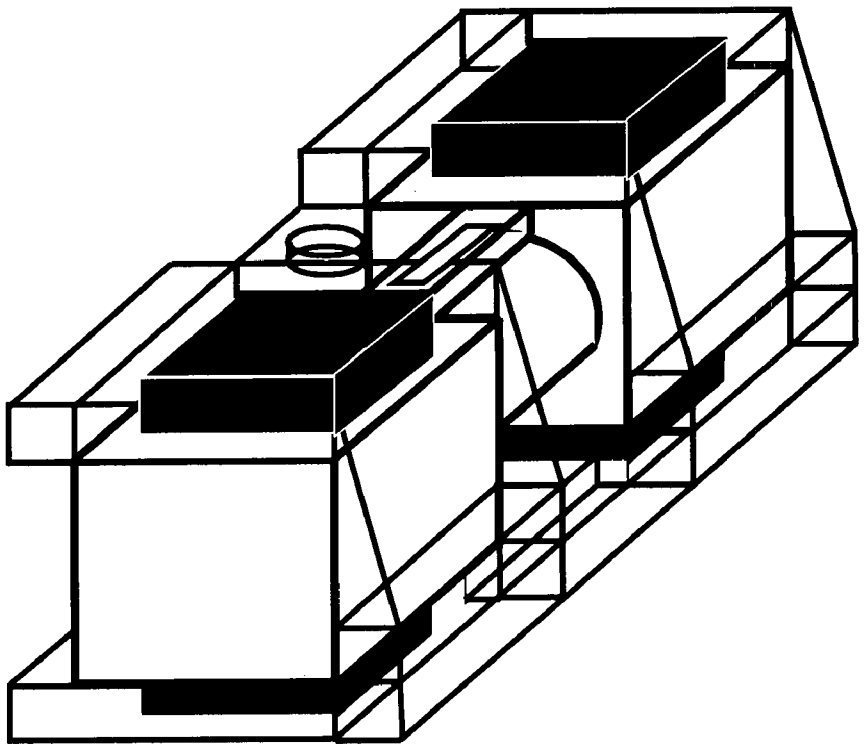
Figure 10A:
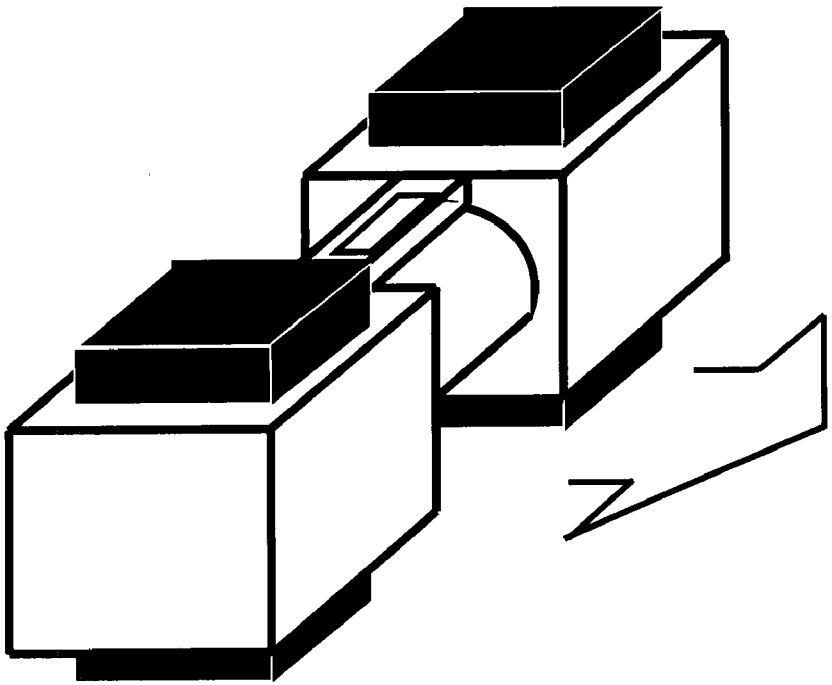
Figure 11D:
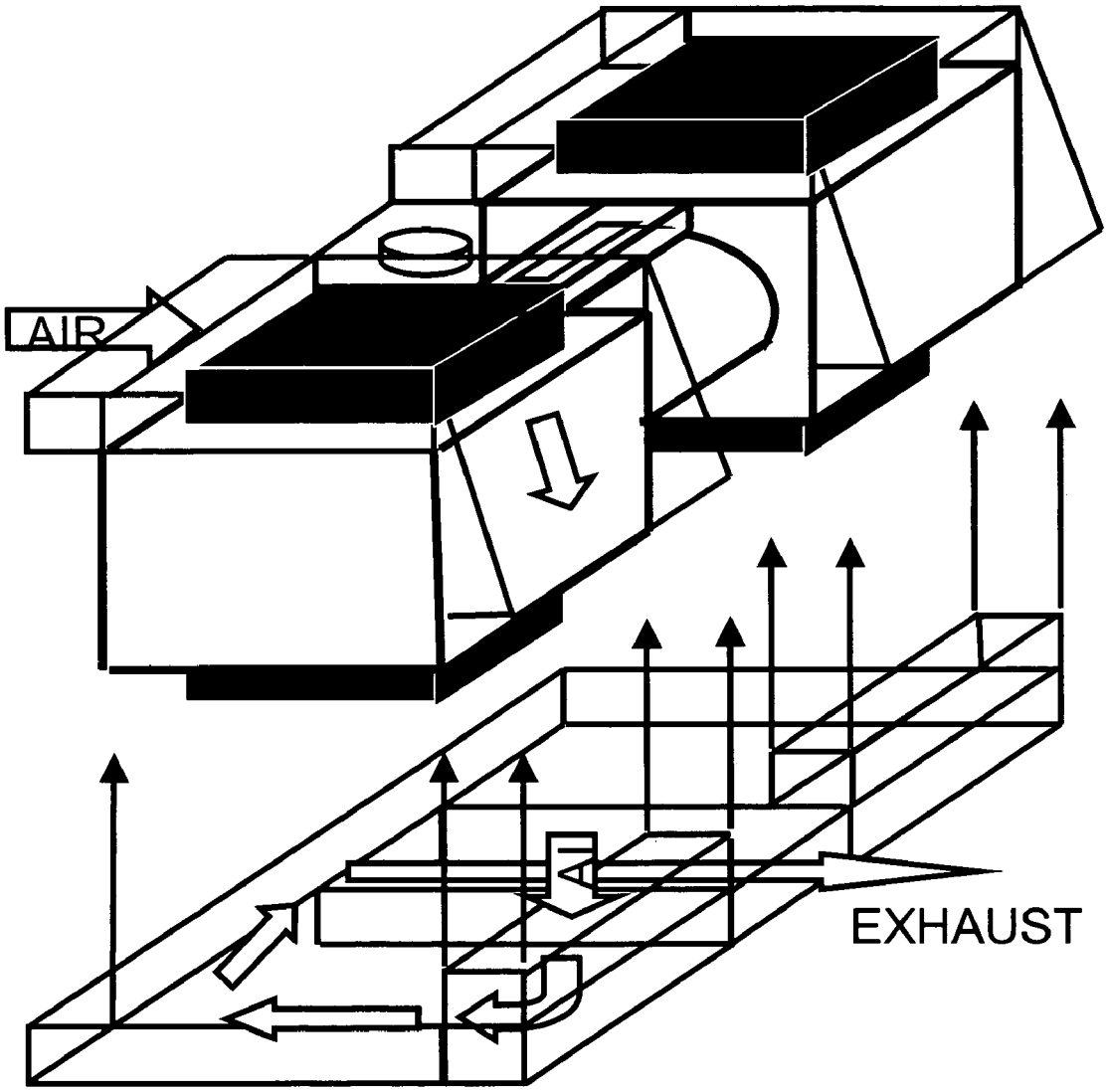

FIG. 3A is a diagram illustrating pressure versus volume plot (P vs V plot) and temperature versus entropy plot (T v S plot) for the right chamber of a stirling engine according to an aspect of the present invention and useable with any one of a stirling engine of FIG. 1, FIGS. 2A through 2D, and/or any other aspects (whether any other aspect is taken alone or in any combination of aspects) of the present invention as may be illustrated and/or disclosed;

FIG. 3B is a diagram illustrating pressure versus volume plot (P vs V plot) and temperature versus entropy plot (T v S plot) for the left chamber of a stirling engine according to an aspect of the present invention and useable with any one of a stirling engine of FIG. 1, FIGS. 2A through 2D, and/or any other aspects (whether any other aspect is taken alone or in any combination of aspects) of the present invention as may be illustrated and/or disclosed;

FIG. 4A is a diagram illustrating an exploded view of a rotary displacer according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 4B is a diagram illustrating an exploded view of a rotary displacer according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 5A is a diagram illustrating a portion of a simplified cycle (state 1, piston at far right, left displacer down, right displacer up) according to an aspect of the present invention and useable with a stirling engine of FIGS. 5A through 5D and/or any other aspects (whether any other aspect is taken alone or in any combination of aspects) of the present invention as may be illustrated and/or disclosed;

FIG. 5B is a diagram illustrating a portion of a simplified cycle (state 2, piston at far left, left displacer down, right displacer up) according to an aspect of the present invention and useable with a stirling engine of FIGS. 5A through 5D and/or any other aspects (whether any other aspect is taken alone or in any combination of aspects) of the present invention as may be illustrated and/or disclosed;

FIG. 5C is a diagram illustrating a portion of a simplified cycle (state 3, piston at far left, left displacer up, right displacer down) according to an aspect of the present invention and useable with a stirling engine of FIGS. 5A through 5D and/or any other aspects (whether any other aspect is taken alone or in any combination of aspects) of the present invention as may be illustrated and/or disclosed;

FIG. 5D is a diagram illustrating a portion of a simplified cycle (state 4, piston at far right, left displacer up, right displacer down) according to an aspect of the present invention and useable with a stirling engine of FIGS. 5A through 5D and/or any other aspects (whether any other aspect is taken alone or in any combination of aspects) of the present invention as may be illustrated and/or disclosed;

FIG. 5E is a diagram illustrating a simplified cycle according to an aspect of the present invention and useable with a stirling engine of FIGS. 5A through 5D and/or any other aspects (whether any other aspect is taken alone or in any combination of aspects) of the present invention as may be illustrated and/or disclosed;

FIG. 6A is a diagram illustrating an exploded view of a motion-converting feature according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 6B is a diagram illustrating a cross-sectional view of a motion-converting feature according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 7 is a diagram illustrating a cross-sectional view of a stirling engine including an electromagnetic converter according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 8 is a diagram illustrating a cross-sectional view of a stirling engine including a fluidic converter according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 9 is a diagram illustrating a cross-sectional view of a stirling engine including a mechanical converter according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 10A is a diagram illustrating an isometric view of a stirling engine according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 10B is a diagram illustrating an isometric view of a stirling engine including a heat-recovery mechanism according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 11A is a diagram illustrating a top orthogonal view of a stirling engine including a heat-recovery mechanism according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 11B is a diagram illustrating a side cross-sectional view of a stirling engine including a heat-recovery mechanism according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed;

FIG. 11C is a diagram illustrating a front orthogonal view of a stirling engine including a heat-recovery mechanism according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed; and FIG. 11D is a diagram illustrating an exploded isometric view of a stirling engine including a heat-recovery mechanism showing air flow according to an aspect of the present invention and useable with any one of a stirling engine of FIG. 1, a stirling engine of FIGS. 2A through 2D, a stirling engine of FIGS. 5A through 5D, and/or any other aspects (whether any other aspect is taken alone or in any combination of aspects) of the present invention as may be illustrated and/or disclosed.

The present invention is directed towards a number of aspects and/or embodiments connected with a stirling engine and/or a self-contained stirling engine including, without limitation, any one of a system including a stirling engine, a method for converting heat energy to any one of mechanical energy, electrical energy, a hydraulic energy, or any combination of any of the preceding. That is, the present invention is directed towards a simple, efficient device that converts heat energy to useful work.

Applicant includes the following scenarios to provide an understanding of the present invention. It should be understood that the present invention may apply, without limitation, to any one of a stirling engine, a self-contained stirling engine, a method for converting heat energy to any one of mechanical energy, electrical energy, fluid energy, or any combination of any of the preceding and is not limited to the following scenarios.

Consider for a moment a location including any one of remote from one or more utilities (e.g., electrical, gas, . . . etc.), remote from one or more fuel sources (e.g., petroleum-based fuels); inconvenient for using one or more utilities (e.g., electrical, gas, . . . etc.); inconvenient for using one or more fuel sources (e.g., petroleum-based fuels); or any combination of the preceding and having available at least one heat source. Such a heat source may permit an operation of a stirling engine according to an aspect of the present invention.

According to an aspect of the present invention, a temperature differential between any one of one or more water sources and the air, one or more water sources and the earth, the air and the earth, or any combination of the preceding may be available at a remote location inconvenient to utilities, fuel sources, or any combination of the preceding and may be used as a heat source to permit an operation of a stirling engine. In turn, such a stirling engine may be incorporated in and/or used as any one of a system for pumping water; a system for providing portable power for one or more electrical devices including, for example, portable devices; a system including a compressor; or any combination of the preceding.

According to another aspect of the present invention, an inexpensive and safe fuel such as, for example, a low concentration water-alcohol mixture may be used to provide a heat source to permit an operation of a stirling engine. In turn, such a stirling engine may be incorporated in and/or used as a system for providing portable power for one or more electrical devices including, for example, portable devices such as a handheld device, a laptop computer, . . . etc.

According to another aspect of the present invention, heat of engine exhaust may be used as a heat source to permit an operation of a stirling engine. In turn, such a stirling engine may be incorporated in and/or used as any one of a system including an alternator to charge, for example, a battery of an automobile; a system including compressor to provide air conditioning to, for example, an automobile; or any combination of the preceding.

According to another aspect of the present invention, any one of a camp fire, wood burning stove, fireplace, camp stove, or any combination of any of the preceding may be used as a heat source to permit an operation of a stirling engine. In turn, such a stirling engine may be incorporated in and/or used as an electrical power source.

According to another aspect of the present invention, any appropriate heat source may be used to permit an operation of a stirling engine. In turn, such a stirling engine may be incorporated in and/or used as power plant (e.g., via electric motors, provide pressurized hydraulic fluid which would move the vehicle using hydraulic motors, or provide pressurized air which would move the vehicle using pneumatic motors) for a hybrid vehicle.

According to another aspect of the present invention, any appropriate heat source may be used to permit an operation of a stirling engine. In turn, such a stirling engine may be incorporated in and/or used as a heat pump. One advantage could be a use of an environmentally friendly cooling fluid such as, for example, helium.

According to another aspect of the present invention, any appropriate heat source may be used to permit an operation of a stirling engine. In turn, such a stirling engine may be incorporated in and/or used as a power source in locations where other types of power are impractical. For example: where noise, vibration, and heat are important parameters.

According to another aspect of the present invention, a non-fossil fuel heat source such as any one of corn, alcohol, soy bean, a solar collector, or any combination of any of the preceding may be used as a heat source to permit an operation of a stirling engine. In turn, such a stirling engine may be incorporated in and/or used as any one of an electrical power source, a mechanical power source, a hydraulic power source or any combination of the preceding.

According to another aspect of the present invention, body heat may be used as a heat source to permit an operation of a stirling engine. In turn, such a stirling engine may be incorporated in and/or used as a power plant for a device such as any one of a watch, a pacemaker, a physiology monitor, or any combination of any of the preceding.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general, and FIGS. 1, 7, 8, 9, 10A, 10B, 10C, 11A, 11B, 11C, and 11D in particular, it will be understood that the illustrations are for the purpose of describing one or more aspects and/or embodiments of the invention and are not intended to limit the invention thereto. As seen in FIGS. 1, 7, 8, 9, 10A, 10B, 10C, 11A, 11B, 11C, and 11D, a stirling engine, generally designated 12, is shown according to the present invention. The stirling engine 12 includes at least two fluid chambers 14, 14' including a displacer 40 and a movable seal 16 separating the at least two fluid chambers 14, 14'. The stirling engine 12 further may include any one of at least one heat source 22, at least one heat sink 24, at least one converter 20, or any combination of any two or more of the preceding.

The at least one heat source 22 may have any structure that permits a stirling engine 12 to perform its function. Examples include, without limitation, any one of a solar heat source, a fossil fuel-fired heat source, a heat recoverer for recovering heat from another process, or any combination of any two or more of the preceding. FIGS. 11A, 11B, 11C, and 11D include an example of a fossil fuel-fired heat source, namely, a burner. Such fossil fuel-fired heat source may include, without limitation, any one of a petroleum-based-fired heat source, a coal-based-fired heat source, a natural-gas-based-fired heat source, a peat-based-fired heat source, a wood-based-fired heat source, a corn-based-fired heat source, or any combination of any two or more of the preceding.

A stirling engine 12 may include a heat-recovery mechanism 42 as illustrated in FIGS. 11A, 11B, 11C, and 11D. Alternatively or additionally, a heat recoverer may be used to recover heat from another process. As a non-limiting example, a heat recoverer may be capable of handling exhaust from another process or operation and recover the energy from such exhaust.

A heat sink 24 may be made using a material or combination of materials having any one of a relatively high specific heat, a relatively high thermal conductivity, or any combination of any of two or more of the preceding. In this manner, energy may be removed from a working fluid proximate to a heat sink 24 and thereby facilitate a more effective operation of a stirling engine according to an aspect of the present invention. In another aspect, a heat sink 24 further may include at least one mechanism 66 capable of facilitating force convection, such as, for example, the fins shown in FIGS. 7, 8, and 9. This too may facilitate a more effective operation of a stirling engine according to an aspect of the present invention. An alternative or additional mechanism 66 capable of facilitating force convection includes a fan as illustrated in FIGS. 11B and 11C.

Returning to FIGS. 7, 8, and 9, a converter 20 may include any one of a mechanical converter (see e.g., FIG. 9), an electromagnetic converter 72 capable of converting motion into electricity (see e.g., FIG. 7), a fluidic converter 74 capable of converting motion into fluid pressure (see e.g., FIG. 8), or any combination of any two or more of the preceding. A mechanical converter further may include at least one magnetic coupling 70 (not shown).

Returning now to FIGS. 1, 7, 8, 9, 10A, 10B, 10C, 11A, 11B, 11C, and 11D, each fluid chamber 14, 14' may be capable of operating at a temperature and a pressure that permit an effective operation of a stirling engine according to an aspect of the present invention. For example, without limitation, each fluid chamber 14, 14' may be capable of operating at a temperature of up to at least about 1000° F. Also, each fluid chamber 14, 14' further includes a housing 26, 26' and, as noted above, at least two heat exchangers (e.g., hot 30, 30') (e.g., cold 32, 32'). As with each fluid chamber 14, 14', each housing 26, 26' and/or heat exchanger (e.g., hot 30, 30') (e.g., cold 32, 32') may be capable of operating at a temperature and a pressure that permit an effective operation of a stirling engine according to an aspect of the present invention. For example, without limitation, each housing 26, 26' and/or heat exchanger (e.g., hot 30, 30') (e.g., cold 32, 32') may be capable of operating at a pressure of up to at least about 1000 pounds per square inch (psi). Also without limitation, each housing 26, 26' is capable of operating at an elevated temperature.

In an aspect, each housing 26, 26' may be made using any combination of one or more materials capable of being or creating a thermal insulator. In another aspect, each heat exchanger (hot 30, 30') (cold 32, 32') may be made using any combination of one or more materials capable of being or creating a thermal conductor. Alternatively or additionally, each heat exchanger (hot 30, 30') (cold 32, 32') further may include a feature 44 capable of decreasing its thermal resistance. As shown FIGS. 7, 8, and 9, examples of a feature 44, without limitation, include any one of a feature external to a chamber, a feature internal to chamber 14, 14', or any combination of any two of the preceding. Examples of types of features 44, without limitation, include any one of one or more fins (e.g., as shown FIGS. 7, 8, and 9), a feature complementary with a displacer 40, a heat pipe, or any combination of any two or more of the preceding.

In an aspect, each fluid chamber 14, 14' further may include a seal feature 34, for example, as shown in FIGS. 7, 8, and 9

In operation, each fluid chamber 14, 14' further includes a working fluid 36, 36'. Each working fluid 36, 36' may be pressurized. To that end, an initial pressure in each fluid chamber 14, 14' may be substantially the same. In turn, each working fluid 36, 36' may be initially pressurized up to at least about 200 pounds per square inch (psi). Further, each working fluid 36, 36' may become pressurized up to a pressure such that an upper operating pressure may be up to at least about 1000 pounds per square inch (psi). Examples of a working fluid 36, 36', without limitation, may include any one of a gas, a fluid capable of phase transition during an operation of the stirling engine, or any combination of any two or more of the preceding. Examples of a gas, without limitation, may include an inert gas, such as, for example, without limitation, any one of helium, nitrogen, argon, or any combination of any two or more of any of the preceding.

In an aspect, each displacer 40 may be made using any combination of one or more materials capable of being or creating an insulator. Turning now to FIGS. 6A and 6B, each displacer 40 further may include a motion-converting feature 56 adapted to convert linear motion of a movable seal 16 to rotary motion of the displacer 40. In an aspect, a motion-converting feature 56 further may include at least one guide pin 60 and at least one groove pin 62. Also in an aspect, any one of an at least one guide pin 60 may communicate with a feature of the movable seal 16, an at least one groove pin 62 may be attached to a housing 26, 26' of a chamber 14, 14', an at least one guide pin 60 may be movable within a groove of the at least one groove pin 62, a guide pin 60 may be capable of motivating a displacer 40, an at least one guide pin 60 and an at least one groove pin 62 may be made using any combination of one or more materials capable of being or creating a wear-resistant material, or any combination of any two or more of any of the preceding. For example, without limitation, a wear-resistant material may be any one of one or more coating, a hardened metal, or any combination of any two or more of any of the preceding. In an aspect, a coating may include any one of a wear-resistant coating, a lubricious coating, or any combination of any two or more of any of the preceding.

In an aspect, a shape of a displacer 40 may complement a shape of a heat exchanger. In another aspect, a movable seal 16 may include, without limitation, any one of a flexible membrane, a piston, a heat pipe, or any combination of any two or more of the preceding. In turn, a flexible membrane may include, without limitation, a polymeric material. As to a piston, it further may include a vent. As shown in FIGS. 1, 7, 8, 9, 10A, 10B, 10C, 11A, 11B, 11C, and 11D, in an aspect, a stirling engine 12 further may include an expansion chamber 64 capable of accommodating a movement of the movable seal 16.

The present invention is directed to a stirling engine 12 including at least two fluid chambers 14, 14'; a displacer 40, which may be rotary; and a movable seal 16. At least one displacer 40 may be included in each of the at least two fluid chambers 14, 14'. The movable seal 16 separates the at least two fluid chambers 14, 14'. In a further aspect, a stirling engine 12 of the present invention may include any one of at least one heat source 22, at least one heat sink 24, at least one converter 20, or any combination of any two or more of the preceding.

Accordingly, one aspect of the present invention is to provide a stirling engine 12 including at least two fluid chambers 14, 14'; a displacer 40; and a movable seal 16. At least one displacer 40 may be included in each of the at least two fluid chambers 14, 14'. The movable seal 16 separates the at least two fluid chambers 14, 14'.

Another aspect of the present invention is to provide a stirling engine 12 including at least two fluid chambers 14, 14'; a rotary displacer 40; and a movable seal 16. At least one displacer 40 may be included in each of the at least two fluid chambers 14, 14'. The movable seal 16 separates the at least two fluid chambers 14, 14'.

Still another aspect of the present invention is to provide a stirling engine 12 including at least two fluid chambers 14, 14'; a displacer 40, which may be rotary; and a movable seal 16; and any one of at least one heat source 22, at least one heat sink 24, at least one converter 20, or any combination of any two or more of the preceding. At least one displacer 40 may be included in each of the at least two fluid chambers 14, 14'. The movable seal 16 separates the at least two fluid chambers 14, 14'.

In operation, a stirling engine according to a number of aspects and/or embodiments of the present invention may be described with reference to FIG. 1, a simplified cross-sectional view. As shown, a stirling engine includes two fluid chambers 14 and 14', one on the left side 14 and one on the right side 14'. Each fluid chamber 14 and 14' is filled with a working fluid 36 and 36'. Each chamber 14 and 14' includes a cold heat exchanger 32 and 32' and a hot heat exchanger 30 and 30'. These heat exchangers 30, 30', 32, and 32' facilitate the conduction of heat into and out of the fluid chambers 14 and 14'. The heat that is conducted into the fluid chamber 14 or 14' comes from a heat source 22 that is in thermal communication with the hot heat exchangers 30 and 30'. The heat that is conducted out of the fluid chamber 14 or 14' goes to the heat sink 24 that is in thermal communication with the cold heat exchangers 30 and 30'. Each fluid chamber 14 and 14' includes a housing 26 and 26'. The housing 26 and 26' may be constructed of a material that thermally insulates the working fluid 36 and 36' from the ambient atmosphere. Also, the housing may provide mechanical integrity to the fluid chambers 14 and 14'.

Each fluid chamber 14 and 14' includes a displacer 40 and 40'. A purpose of a displacer 40 and 40' may be to displace the working fluid 36 and 36' in such a way that the working fluid 36 and 36' is thermally insulated from one of the heat exchangers 30, 30', 32, and 32'. In an aspect of the invention, design features may be included that result in the displacers 40 and 40' moving in opposite directions or having a phased relationship. That is, as the displacer 40 in the left fluid chamber 14 moves toward the cold heat exchanger 32, the displacer 40' in the right fluid chamber 14' moves toward the hot heat exchanger 30'. Conversely, as the displacer 40 in the left fluid chamber 14 moves toward the hot heat exchanger 30, the displacer 40' in the right fluid chamber 14' moves toward the cold heat exchanger 32'.

When a displacer 40 or 40' moves to a position adjacent to a hot heat exchanger 30 or 30', the working fluid 36 or 36' is forced to come into contact with a cold heat exchanger 32 or 32' and is thermally insulated from the hot heat exchanger 30 or 30'. Conversely, when a displacer 40 or 40' moves to a position adjacent to a cold heat exchanger 32 or 32', the working fluid 36 or 36' is forced to come into contact with a hot heat exchanger 30 or 30' and is thermally insulated from the cold heat exchanger 32 or 32'.

When the working fluid 36 or 36' comes into contact with a hot heat exchanger 30 or 30', heat flows from an external heat source 22 through the hot heat exchanger 30 or 30' and causes the temperature of the working fluid 36 or 36' to rise. When the working fluid 36 or 36' comes into contact with a cold heat exchange 32 or 32', heat flows from the working fluid 36 or 36' to an external heat source 22 through the cold heat exchanger 32 or 32' and causes the temperature of the working fluid 36 or 36' to fall. As the temperature of the working fluid 36 or 36' rises, the working fluid 36 or 36' expands. As the temperature of the working fluid 36 or 36' is lowered, the working fluid contracts. Since the displacers 40 and 40' move in opposite directions or have a phased relationship, the working fluid in the left chamber 36 is expanding when the working fluid in the right chamber 36' is contracting and the working fluid in the left chamber 36 is contracting when the working fluid in the right chamber 36' is expanding.

A movable seal 16 (e.g., a piston as shown in FIGS. 1, 2A, 2B, 2C, 2D, 5A, 5B, 5C, and 5D) lies between the two fluid chambers 14 and 14'. The movable seal 16 (e.g., a piston as shown in FIGS. 1, 2A, 2B, 2C, 2D, 5A, 5B, 5C, and 5D) is positioned such that it is in contact with the working fluid 36 and 36' in the two chambers 14 and 14'. As the working fluid in the left chamber 14 and the working fluid in the right chamber 14' are heated or cooled, a pressure differential develops on either side of the movable seal 16 (e.g., a piston as shown in FIGS. 1, 2A, 2B, 2C, 2D, 5A, 5B, 5C, and 5D), causing the movable seal 16 (e.g., a piston as shown in FIGS. 1, 2A, 2B, 2C, 2D, 5A, 5B, 5C, and 5D) to move toward the lower temperature side.

Referring to FIGS. 2A through 2E, the process in the previous paragraphs causes the invention to operate through a four-phase cycle. Each phase of the cycle begins and ends in a steady state condition that is shown in FIGS. 2A through 2E.

Figure 2A:
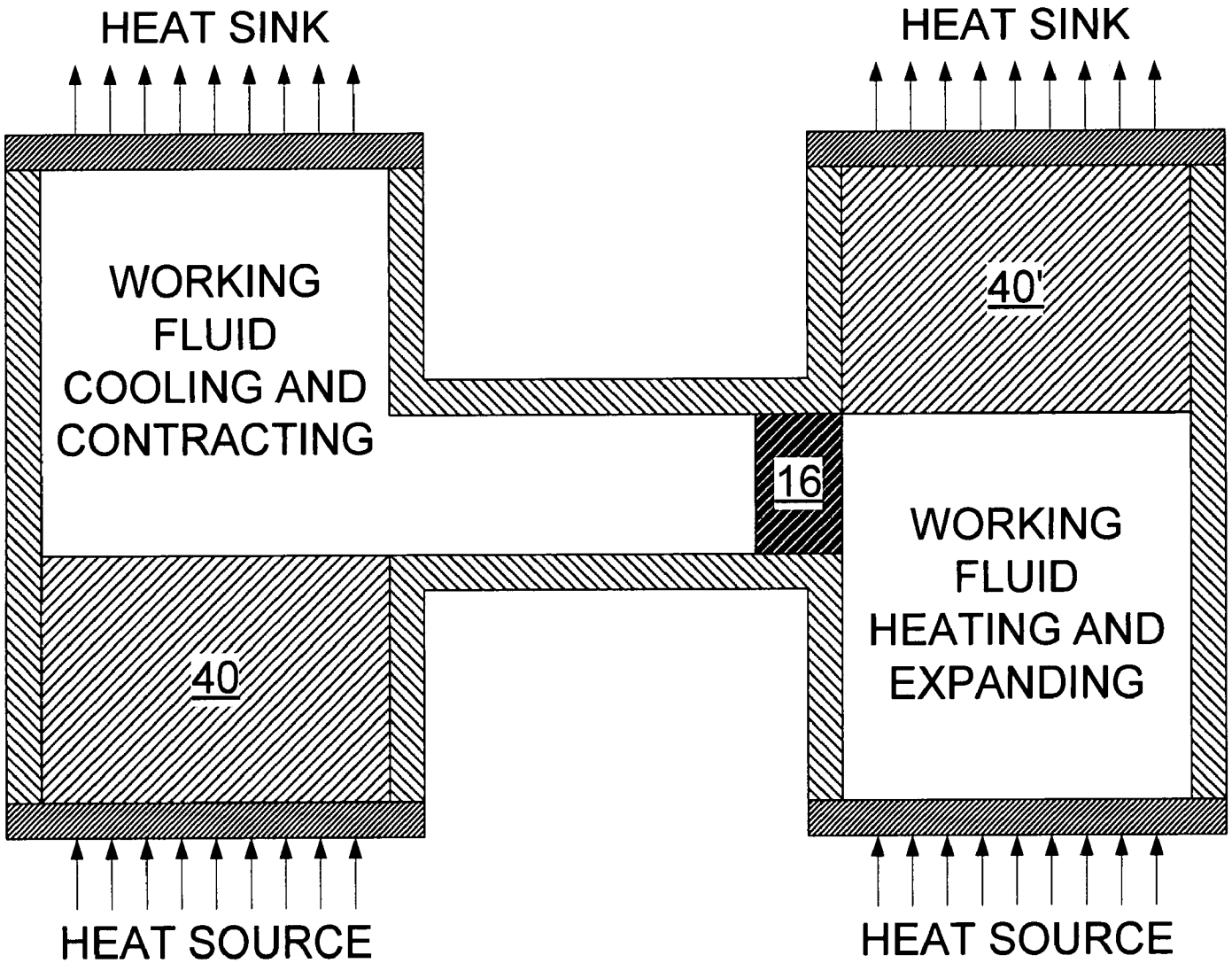
FIG. 2A is a diagram illustrating a portion of a simplified cycle (state 1, piston at far right, left displacer down, right displacer up) according to an aspect of the present invention and useable with a stirling engine of FIG. 1 and/or any other aspects (whether any other aspect is taken alone or in any combination of aspects) of the present invention as may be illustrated and/or disclosed.

FIG. 2A shows the state where the movable seal 16 is at the far right, the displacer in the left fluid chamber 14 is at the bottom, and the displacer 40 in the right fluid chamber 14' is at the top. As the working fluid in the left fluid chamber 36 cools, it contracts. As the working fluid in the right fluid chamber 36' heats, it expands. The resulting pressure differential causes the movable seal 16 to move to the left. This is the beginning of phase one in which the expanding and contracting working fluids 36 and 36' move the movable seal 16 to the left.

Figure 2B:
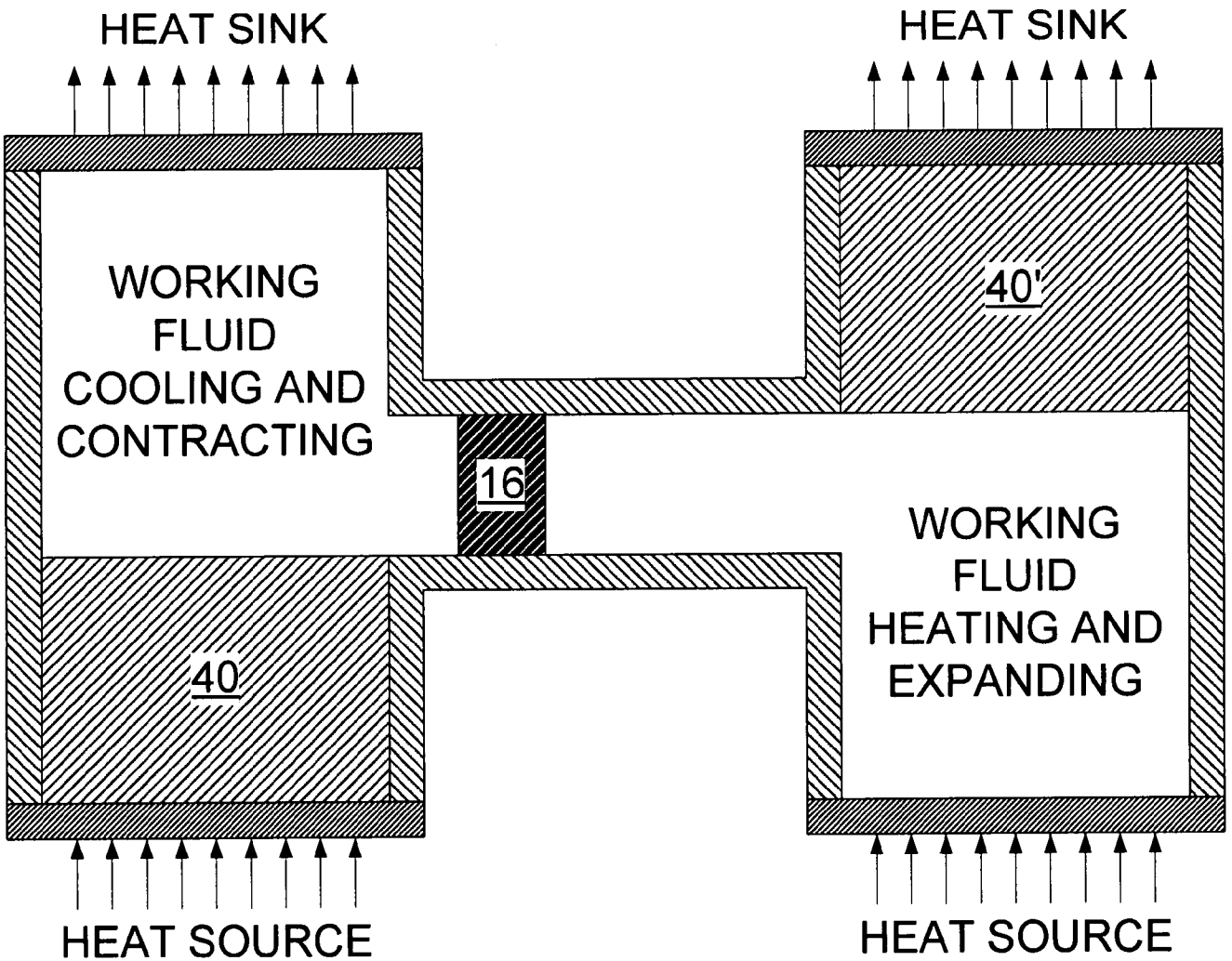
FIG. 2B is a diagram illustrating a portion of a simplified cycle (state 2, piston at far left, left displacer down, right displacer up) according to an aspect of the present invention and useable with a stirling engine of FIG. 1 and/or any other aspects (whether any other aspect is taken alone or in any combination of aspects) of the present invention as may be illustrated and/or disclosed.

FIG. 2B shows the state where the movable seal 16 is nearing the far left, the displacer 40 in the left fluid chamber 14 is at the bottom, and the displacer 40 in the right fluid chamber 40' is at the top. As the movable seal 16 approaches the far left, a design feature in the invention causes the two displacers 40 and 40' to start to move in opposite directions. This is the beginning of phase two in which the two displacers 40 and 40' move in opposite directions or have a phased relationship.

Figure 2C:
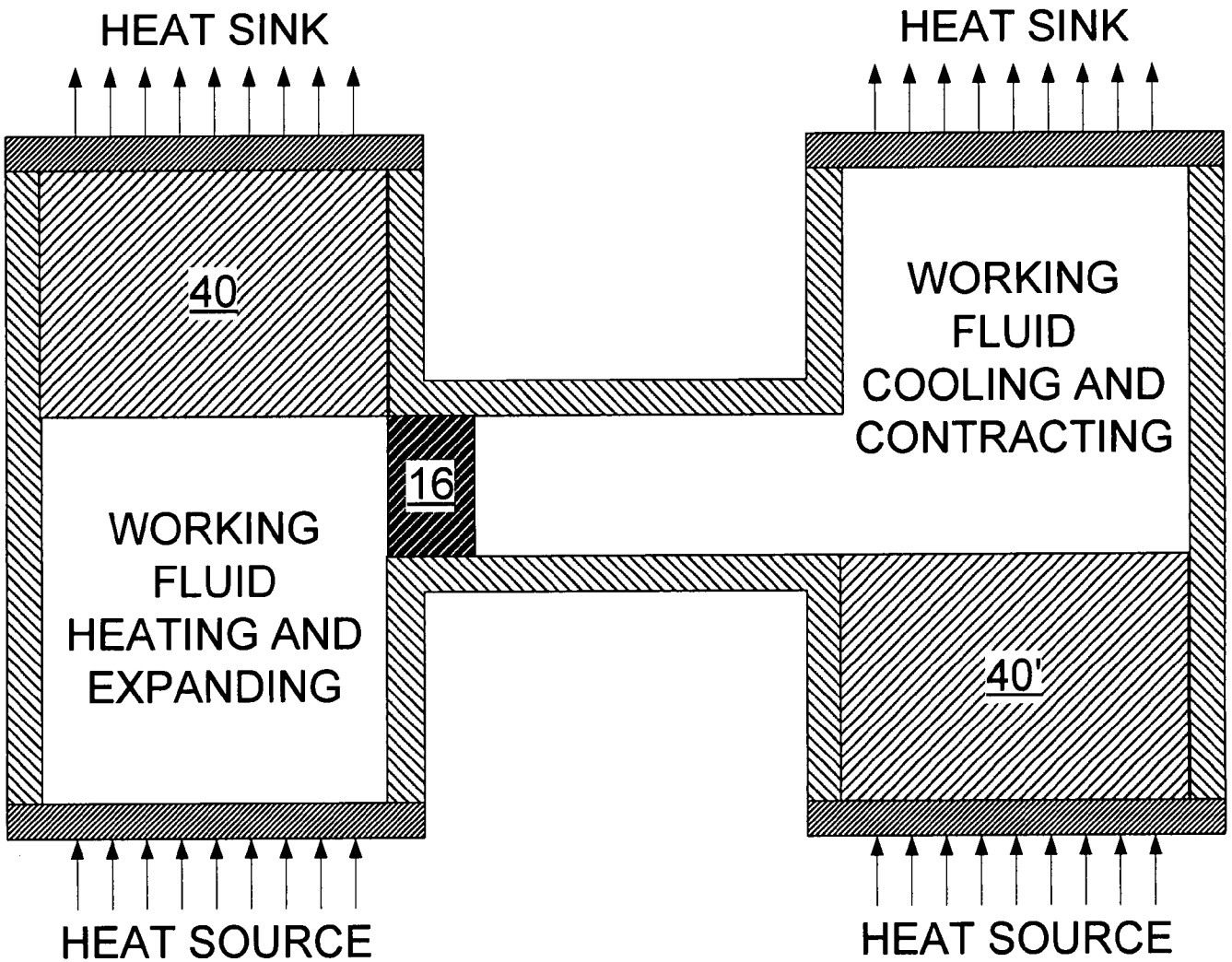
FIG. 2C is a diagram illustrating a portion of a simplified cycle (state 3, piston at far left, left displacer up, right displacer down) according to an aspect of the present invention and useable with a stirling engine of FIG. 1 and/or any other aspects (whether any other aspect is taken alone or in any combination of aspects) of the present invention as may be illustrated and/or disclosed.

FIG. 2C shows the state where the movable seal 16 is at the far left, the displacer in the left fluid chamber 14 is at the top, and the displacer 40 in the right fluid chamber 14' is at the bottom. As the working fluid 36 in the left fluid chamber 14 heats, it expands. As the working fluid 36' in the right fluid chamber 14' cools, it contracts. The resulting pressure differential causes the movable seal 16 to move to the right. This is the beginning of phase three in which the expanding and contracting working fluids 36 and 36' move the movable seal 16 to the right.

Figure 2D:
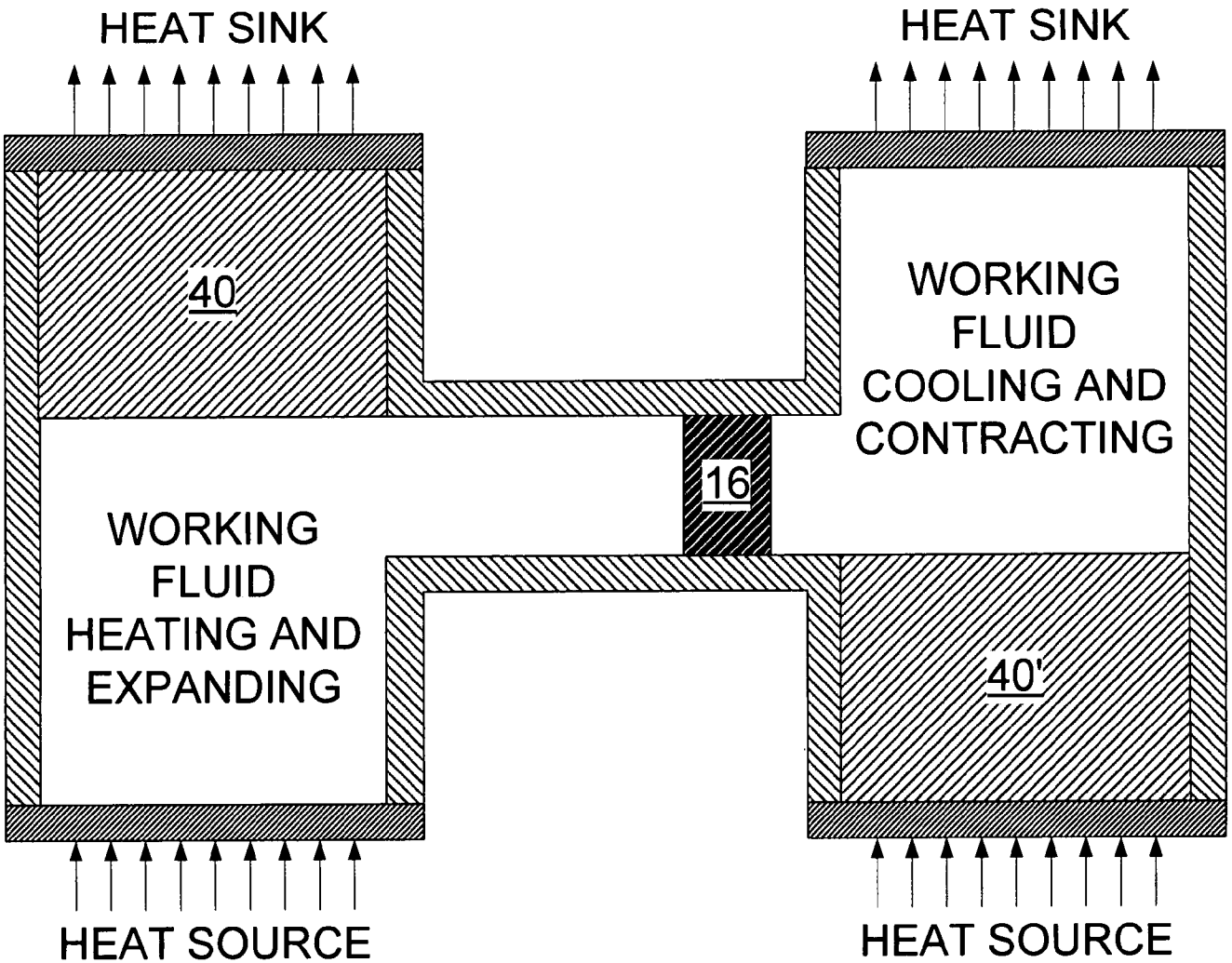
FIG. 2D is a diagram illustrating a portion of a simplified cycle (state 4, piston at far right, left displacer up, right displacer down) according to an aspect of the present invention and useable with a stirling engine of FIG. 1 and/or any other aspects (whether any other aspect is taken alone or in any combination of aspects) of the present invention as may be illustrated and/or disclosed.
Figure 2E:
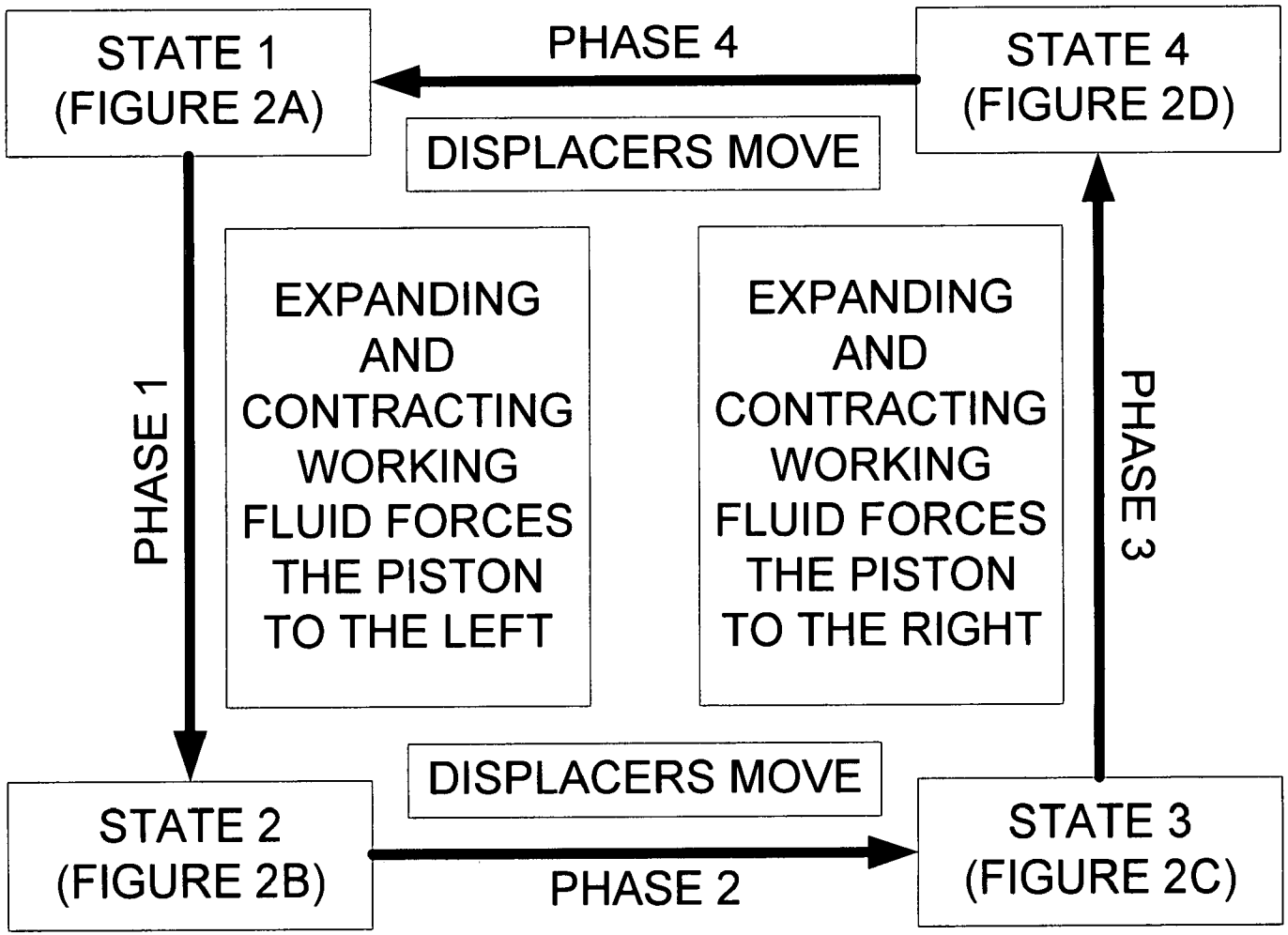
FIG. 2E is a diagram illustrating a simplified cycle according to an aspect of the present invention and useable with a stirling engine of FIG. 1 and/or any other aspects (whether any other aspect is taken alone or in any combination of aspects) of the present invention as may be illustrated and/or disclosed.

FIG. 2D shows the state where the movable seal 16 is nearing the far right, the displacer in the left fluid chamber 14 is at the top, and the displacer 40 in the right fluid chamber 14' is at the bottom. As the movable seal 16 approaches the far right, a design feature in the invention causes the two displacers 40 and 40' to start to move in opposite directions. This is the beginning of phase four in which the two displacers 40 and 40' move in opposite direction or have a phased relationship.

At an end of phase four, the cycle is at the state depicted in FIG. 2A. This cycle continues as the movable seal 16 moves back and forth. FIGS. 3A and 3B show the cycle in the pressure versus volume plot (P vs V plot) and the temperature versus entropy plot (T vs S plot). Note that the numbers 1 through 4 on FIGS. 3A and 3B relate to the states 1 through 4 in FIGS. 2A through 2D. The same process takes place in both fluid chambers 14 and 14'; however, the process is out of phase as indicated by the positions of the numbers 1 through 4.

In an embodiment relating to a self-contained stirling engine 12, the displacers 40 and 40' are implemented using a rotating or rotary displacer design. These rotary displacers 40 and 40' have a design feature that allows them to conform to the shape of the heat exchangers 30, 30', 32, and 32' while at the same time allowing them to exchange positions in a rotational manner or have a phased relationship. This design also permits the use of design features in the heat exchangers 30, 30', 32, and 32' that promote more efficient exchange of heat than would otherwise be possible. FIGS. 4A and 4B illustrate these design features. FIG. 4A shows an exploded view of a rotary displacer 40, a hot heat exchanger 30, and a cold heat exchanger 32. The heat exchangers incorporate design features that amplify the contact area between the heat exchangers 30 and 32 and the working fluid 36 and 36'. These design features may be in the form of grooves that contain the working fluid 36 and 36'. The displacer 40 has design features that complement the grooves to displace the working fluid. As the displacer 40 rotates around its axis, the working fluid is alternately exposed to the hot heat exchanger 30 and the cold heat exchanger 32. FIG. 4B shows the displacer 40, hot heat exchanger 30, and the cold heat exchanger 32 in their assembled position. The housing 26 has been removed to allow one to see the relationship of these parts. The other fluid chamber 14' is similarly composed of the displacer 40', the hot heat exchanger 30', and the cold heat exchanger 32'.

FIGS. 5A through 5E illustrate the stirling operating cycle that incorporates the design features associated with FIGS. 4A and 4B. Note that the cycle is substantially identical to the cycle illustrated in FIGS. 2A through 2E.

An aspect of a self-contained stirling engine includes a mechanism to translate a linear motion of the movable seal 16 (e.g., a piston as shown in FIGS. 1, 2A, 2B, 2C, 2D, 5A, 5B, 5C, and 5D) into a rotary motion of the displacers 40 and 40'. This mechanism includes design features that also synchronize or coordinate the motions of the displacers 40 and 40' to the motion of the movable seal 16 (e.g., a piston as shown in FIGS. 5A, 5B, 5C, and 5D) for the purpose of accomplishing the cycle as illustrated in FIGS. 5A through 5D.

Aspects of the design features that perform this motion translation are shown in FIGS. 6A and 6B. FIG. 6A shows an exploded view of the parts that make up the motion translation design for one fluid chamber 14. There is a hole in the movable seal 16 that is threaded and is designed to allow the guide pin 60 to be attached by way of threads on the guide pin 60. The guide pin 60, when attached to the movable seal 16, protrudes through a slot in the displacer 40. In addition, the guide pin 60 protrudes into a groove in the grooved pin 62. The grooved pin 62 may be secured to the housing 26 so that it cannot rotate or translate. FIG. 6B shows the parts in their assembled position. As the movable seal 16 moves linearly, it is constrained to follow the grooved pin. The groove in the grooved pin 62 is designed so that the guide pin 60 will follow the groove in a linear motion until the movable seal 16 is near the end of its travel. When the movable seal 16 reaches the end of its travel, the groove in the grooved pin 62, which goes around the grooved pin 62, forces the guide pin 60 to rotate around the grooved pin 62. This motion also causes the movable seal 16 to rotate around the grooved pin 62 along its axis. The protrusion of the guide pin 60 into the groove in the displacer 40 causes the displacer 40 to rotate along with the movable seal 16 and the guide pin. The other fluid chamber 14' has an identical arrangement to convert the linear motion of the movable seal 16 into rotary motion in the displacer 40' and the guide pin 60'.

In one aspect of the invention, a capability may be included so that a stirling engine is capable of doing work to produce an electric current. This aspect is illustrated in FIG. 7. In this aspect, the invention includes elements discussed in the previous paragraph. In addition, this aspect of the invention includes a strong magnet that is included in a movable seal 16. Also, the aspect includes a coil and associated circuitry 72. The motion of the movable seal 16 as it passes through the coil 72 produces an electric current that is conditioned and controlled by the circuitry 72.

In another aspect of the invention, a capability may be included to do work by producing a pressure in a fluid. This aspect of the invention is illustrated in FIG. 8. In this aspect, the invention includes elements discussed in the previous paragraph. In addition, this aspect of the invention includes a channel 74 in each groove pin 62. These channels include a design feature that allows a valve assembly to be connected to a hole. This valve assembly is not shown in the figure. The purpose of the valve assembly is to direct the flow of the fluid in one direction and to ensure that the fluid remains under pressure. The motion of the movable seal 16 causes fluid to flow through the channels 74.

When the movable seal 16 moves to the left, fluid is drawn into the right channel 74 through the valve assembly. At the same time, fluid in the left side is compressed and expelled through the left side channel 74 into the valve assembly. When the movable seal 16 moves to the right, fluid is drawn into the left channel 74 through the valve assembly. At the same time, fluid in the right side is compressed and expelled through the right side channel 74 into the valve assembly.

In another aspect of the invention, a capability may be included to do work by producing a rotating shaft. This aspect of the invention is illustrated in FIG. 9. In this aspect, the invention includes elements discussed in the previous paragraph. In addition, this aspect of the invention includes modifications to a movable seal 16, a guide pin 60, and a grooved pin 62. In addition, this aspect of the invention includes guide pin bearings 84 to support side loads on each guide pin, an output shaft 80, and output shaft bearings 82 to support side loads on the output shaft 80. There is a design feature on the movable seal 16 that acts as a spline shaft 86 and engages grooves in the output shaft 80. These grooves permit the movable seal 16 to move along the axis while providing a rotational force to the output shaft 80. In order to create a continuous rotation, the groove in the groove pin 62 is a continuous oval shape as opposed to the shape discussed previously.

A heat recovery design feature may be included in yet another aspect of the invention in order to increase the thermal efficiency. This heat recovery feature is illustrated in FIGS. 10A, 10B, 11A, 11B, 11C, and 11D. FIG. 10A shows a simplified isometric view of the invention with the airflow, cooling, and heating portions removed. FIG. 10B shows the invention with the airflow, cooling, and heating portions attached. In this isometric view, the airflow, cooling, and heating portions are shown in a phantom view so that the relationship between the components can be seen. FIGS. 11A, 11B, and 11C are orthogonal views of the invention with the airflow, cooling, and heating portions in place. FIG. 11B shows a cutaway view so that the airflow may be illustrated.

In operation of the heat recovery method, air enters through air cleaners. The filtered air passes over the cold heat exchanger and is directed to the fan 66 by the heat recovery ducting 42. Heat is transferred to the air as it passes through the heat exchanger. The air acts as a heat sink and maintains the cold heat sink at a low temperature. The fan 66 pulls the heated air from the heat recovery duct and passes it to the burner. Since the air is pre-heated, less energy is required to heat it to the desired operating temperature. The air is heated by the burner 22 and is directed past the hot heat exchanger. Heat is transferred to the hot heat exchanger. This heated air acts as a heat source for the invention and maintains the hot heat exchanger at a high temperature. After the air interacts with the hot heat exchanger, it exits the invention via the exhaust. FIG. 11D is an isometric view with the lower part removed to show the airflow through the lower part of the invention. This process is identical for both sides of the invention.

Certain modifications and improvements will occur to those skilled in the art upon a reading of the foregoing description. By way of one example, springs may be attached to the piston assembly or groove pins to assist in reversing piston direction. By way of another example, bushings, bearings, and/or a pressurized lubrication system may be used to prevent friction and wear. By way of another example, displacers may include a balancing feature to reduce vibration. Also, an assembly and/or reservoir may be incorporated to replace working fluid lost due to leakage. In addition, features may be incorporated to permit working fluid filling during manufacture. Further, a variety of materials may be incorporated to reduce cost and weight and/or to increase efficiency and reliability. The insulating material may be ceramic, plastic, carbon fiber, or some combination of these or other materials. The conducting material may be aluminum, ceramic or some combination of these of other materials. Moreover, the shape of the groove pattern in the grooved pin may be modified in order to optimize performance for various applications. It should be understood that all such modifications and improvements have been deleted herein for the sake of conciseness and readability but are properly within the scope of the following claims.

I claim:

1. A stirling engine comprising:

(a) at least two fluid chambers;

(b) a rotary displacer in each of the at least two fluid chambers;

(c) a movable seal separating the at least two fluid chambers; and (b) each displacer includes a motion-converting feature adapted to convert motion of the movable seal to rotary motion of the displacer, the motion-converting feature comprising at least one guide pin and at least one groove pin, wherein any one of the:

(i) at least one guide pin communicates with a feature of the movable seal;

(ii) at least one groove pin is attached to a housing of a chamber;

(iii) at least one guide pin is movable within a groove of the at least one groove pin;

(vi) at least one guide pin is capable of motivating a displacer;

(v) at least one guide pin and the at least one groove pin comprise a wear-resistant material; or (vi) any combination of any two or more of any of the preceding.

2. The stirling engine according to claim 1, wherein the wear-resistant material comprises any one of a coating, a hardened metal, or any combination of any two or more of any of the preceding.

3. The stirling engine according to claim 2, wherein the coating comprises any one of a wear-resistant coating, a lubricious coating, or any combination of any two or more of any of the preceding.

4. The stirling engine according to claim 1, wherein each fluid chamber is capable of operating at a temperature of up to at least about 1000° F.

5. The stirling engine according to claim 1, wherein each fluid chamber further includes a housing and at least two heat exchangers.

6. The stirling engine according to claim 5, wherein each housing and heat exchanger is capable of operating at a pressure of up to at least about 1000 pounds per square inch (psi).

7. The stirling engine according to claim 5, wherein each housing is capable of operating at an elevated temperature.

8. The stirling engine according to claim 5, wherein each housing comprises a thermal insulator.

9. The stirling engine according to claim 5, wherein each heat exchanger comprises a thermal conductor.

10. The stirling engine according to claim 1, further including a feature capable of decreasing a thermal resistance at any one of an interface between a working fluid and a hot heat exchanger, an interface between a working fluid and a cold heat exchanger, or any combination of the preceding.

11. The stirling engine according to claim 10, wherein the feature comprises any one of a feature external to a chamber, a feature internal to a chamber, or any combination of any two of the preceding.

12. The stirling engine according to claim 10, wherein the feature comprises any one of one or more fans, a feature complementary with a displacer, a heat pipe, or any combination of any two or more of the preceding.

13. The stirling engine according to claim 1, wherein each fluid chamber further includes seal features.

14. The stirling engine according to claim 13, wherein any one of the seal features further including an interference fit, the seal features further including at least one fastener, or any combination of any two or more of the preceding.

15. The stirling engine according to claim 1, wherein each fluid chamber further includes a working fluid.

16. The stirling engine according to claim 15, wherein each working fluid is pressurized.

17. The stirling engine according to claim 15, wherein an initial pressure in each fluid chamber is substantially the same.

18. The stirling engine according to claim 16, wherein each working fluid is pressurized up to at least about 200 pounds per square inch (psi).

19. The stirling engine according to claim 18, wherein each working fluid is pressurized up to a pressure such that an upper operating pressure is up to at least about 1000 pounds per square inch (psi).

20. The stirling engine according to claim 15, wherein the working fluid comprises any one of a gas, a fluid capable of phase transition during an operation of the stirling engine, or any combination of any two or more of the preceding.

21. The stirling engine according to claim 20, wherein the gas comprises an inert gas.

22. The stirling engine according to claim 21, wherein the inert gas comprises any one of helium, nitrogen, argon, or any combination of any two or more of any of the preceding.

23. The stirling engine according to claim 1, further including a heat-recovery mechanism.

24. The stirling engine according to claim 1, wherein each displacer comprises an insulator.

25. The stirling engine according to claim 1, wherein a shape of the displacer complements a shape of a heat exchanger.

26. The stirling engine according to claim 1, wherein the movable seal comprises any one of a flexible membrane, a piston, a heat pipe, or any combination of any two or more of the preceding.

27. The stirling engine according to claim 26, wherein the movable seal comprises a piston.

28. The stirling engine according to claim 26, wherein the piston further includes a vent.

29. The stirling engine according to claim 26, wherein the flexible membrane comprises a polymeric material.

30. The stirling engine according to claim 1, further including an expansion chamber capable of accommodating a movement of the movable seal.

31. The stirling engine according to claim 1, further including any one of at least one heat source, at least one heat sink, at least one converter, or any combination of any two or more of the preceding.

32. The stirling engine according to claim 31, wherein the at least one heat source comprises any one of a solar heat source, a fossil fuel-fired heat source, a heat recoverer from another process, or any combination of any two or more of the preceding.

33. The stirling engine according to claim 32, wherein the fossil fuel-fired heat source comprises any one of a petroleum-based-fired heat source, a coal-based-fired heat source, a natural-gas-based-fired heat source, a peat-based-fired heat source, a wood-based-fired heat source, a corn-based-fired heat source, or any combination of any two or more of the preceding.

34. The stirling engine according to claim 32, wherein the heat recoverer from another process comprises exhaust from another process.

35. The stirling engine according to claim 31, wherein the at least one heat sink further includes at least one mechanism capable of facilitating forced convection.

36. The stirling engine according to claim 35, wherein the at least one mechanism capable of facilitating forced convection comprises a fan.

37. The stirling engine according to claim 31, wherein the at least one converter comprises any one of a mechanical converter, an electromagnetic converter capable of converting motion into electricity, a fluidic converter capable of converting motion into fluid pressure, or any combination of any two or more of the preceding.

38. The stirling engine according to claim 37, wherein the mechanical converter further includes at least one magnetic coupling.

* * * * *